US010112401B2

(12) United States Patent
Murakami et al.

(10) Patent No.: US 10,112,401 B2
(45) Date of Patent: Oct. 30, 2018

(54) METHOD OF MANUFACTURING LIQUID EJECTING APPARATUS AND LIQUID EJECTING APPARATUS

(71) Applicant: SEIKO EPSON CORPORATION, Tokyo (JP)

(72) Inventors: Kentaro Murakami, Matsumoto (JP); Hiroyuki Kobayashi, Azumino (JP); Yasushi Yajima, Minowa-machi (JP); Toshiaki Ishikawa, Matsumoto (JP); Toru Chino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/660,549

(22) Filed: Jul. 26, 2017

(65) Prior Publication Data

US 2018/0056657 A1 Mar. 1, 2018

(30) Foreign Application Priority Data

Aug. 31, 2016 (JP) ..... 2016-168866

(51) Int. Cl.
*B41J 2/175* (2006.01)

(52) U.S. Cl.
CPC ..... *B41J 2/1752* (2013.01); *B41J 2/17523* (2013.01)

(58) Field of Classification Search
CPC ..... B41J 2/1752; B41J 2/17523
USPC ..... 347/86
See application file for complete search history.

(56) References Cited

U.S. PATENT DOCUMENTS

2004/0051754 A1* 3/2004 Lim ..... B41J 2/1752 347/20
2012/0044310 A1 2/2012 Yajima et al.
2014/0063123 A1* 3/2014 Saiga ..... B41J 2/145 347/37
2016/0016422 A1 1/2016 Kobayashi et al.

FOREIGN PATENT DOCUMENTS

JP H06-305161 A 11/1994
JP 2004-136555 A 5/2004
JP 2012-040743 A 3/2012
JP 2013-059965 A 4/2013
JP 2016-022610 A 2/2016

* cited by examiner

*Primary Examiner* — Stephen Meier
*Assistant Examiner* — Alexander D Shenderov
(74) *Attorney, Agent, or Firm* — Workman Nydegger

(57) ABSTRACT

A method of manufacturing a liquid ejecting apparatus which includes a container holder on which a first liquid container and a second liquid container are detachably mounted, an nozzles for ejecting the liquid supplied from each of the liquid containers, and an adjuster that is disposed at a position covered by the first liquid container and not covered by the second liquid container, the method including: ejecting liquid by the nozzles in a state in which the second liquid container is mounted without the first liquid container being mounted; and adjusting the liquid ejecting apparatus by the adjuster based on an ejection result in the ejecting of the liquid.

19 Claims, 9 Drawing Sheets

METHOD OF MANUFACTURING LIQUID EJECTING APPARATUS AND LIQUID EJECTING APPARATUS

BACKGROUND

1. Technical Field

The present invention relates to a method of manufacturing a liquid ejecting apparatus such as an ink jet recording apparatus and a liquid ejecting apparatus, and in particular, to a method of manufacturing a liquid ejecting apparatus including a container holding member on which a liquid container is detachably mounted, an ejection mechanism for ejecting the liquid supplied from the liquid container from a nozzle, and an adjustment member that performs adjustment relating to the ejection of the ejection mechanism, and a liquid ejecting apparatus.

2. Related Art

As a liquid ejecting head that ejects (discharges) liquid droplets from a nozzle by generating a pressure fluctuation in the liquid in a pressure chamber, there are, for example, an ink jet recording head (hereinafter, simply referred to as a recording head) used in an image recording apparatus such as an ink jet recording apparatus (hereinafter, simply referred to as a printer), a color material ejecting head used for manufacturing a color filter such as a liquid crystal display, an organic electroluminescence (EL) display, an electrode material ejecting head used for electrode formation such as an FED (a surface emitting display), a bioorganic material ejecting head used for manufacturing a biochip (a biochemical element), and the like. Then, in the recording head for the image recording apparatus, liquid ink is ejected, and in the color material ejecting head for a display manufacturing apparatus, solution of each of color materials R (Red), G (Green), and B (Blue) is ejected. In addition, in the electrode material ejecting head for an electrode forming apparatus, a liquid electrode material is ejected, and in the bioorganic material ejecting head for a chip manufacturing apparatus, solution of a bioorganic material is ejected.

As the liquid ejecting apparatus, for example, there is a configuration in which an ejection mechanism for discharging liquid is fixed to a holding member called a carriage and liquid is ejected from the nozzle of the ejection mechanism with respect to a liquid landing target such as a recording medium (for example, see JP-A-2012-040743). The above-described carriage includes the ejection mechanism and an adjustment member, such as a cam, for adjusting the position of a flow path member that supplies the liquid from the liquid container to the ejection mechanism, the adjustment member is configured to adjust (alignment adjustment) the positions of the ejection mechanism and the flow path member in the carriage, and the ejection mechanism and the flow path member are configured to be fixed to the carriage by a fastening member such as a screw.

In this kind of liquid ejecting apparatus, a liquid container storing liquid to be supplied to the ejection mechanism through the flow path member is detachably mounted on the carriage. For example, in the configuration disclosed in the JP-A-2012-040743, the liquid container is disposed right above the ejection mechanism (a recording head unit) fixed to the carriage. Then, in the above-described alignment adjustment, an inspection pattern (an alignment pattern) is formed by introducing the liquid from the liquid container into a flow path of the ejection mechanism and ejecting the liquid with respect to a liquid landing target, adjustment is performed based on the inspection pattern, and after the alignment adjustment, the ejection mechanism is fixed to the carriage by the fastening member. For this reason, the above-described adjustment member or fastening member is disposed at a position not covered by the liquid container in the carriage.

However, in the configuration in which the adjustment member or the fastening member is disposed at a position not covered by the liquid container, there is a problem that the size of the carriage and the ejection mechanism is increased accordingly. That is, in order to provide a portion to be fixed by the adjustment member and an area for adjusting the adjustment member (an area required for an operation of the adjustment member) up to that position, a space corresponding to the carriage or the like is required. In addition, in a configuration in which the number of processes of attaching and detaching a liquid storage member increases, there is a problem that not only the entire manufacturing process becomes long accordingly, but also the position of the ejection mechanism shifts due to attachment and detachment of the liquid storage member after alignment adjustment.

SUMMARY

An advantage of some aspects of the invention is to provide a method of manufacturing a liquid ejecting apparatus that can suppress an increase in the number of steps of adjustment relating to the ejection of the liquid ejecting apparatus or a liquid ejecting apparatus that can be downsized and a liquid ejecting apparatus.

According to an aspect of the invention, there is provided a method of manufacturing a liquid ejecting apparatus which includes a container holder (that is, container holding member) on which a first liquid container and a second liquid container are detachably mounted, nozzles of an ejection mechanism for ejecting the liquid supplied from each of the liquid containers, and an adjuster (that is, adjustment member) that is disposed at a position covered by the first liquid container and not covered by the second liquid container, the method including: ejecting liquid by the ejection mechanism in a state in which the second liquid container is mounted without the first liquid container being mounted; and adjusting the liquid ejecting apparatus by the adjuster based on an ejection result in the ejecting of the liquid.

According to the aspect of the invention, since the ejecting of the liquid and the adjusting of the liquid ejecting apparatus can be performed in a state in which the first liquid container is not mounted, the number of times of attachment and detachment of the liquid containers required in a manufacturing process is reduced, thereby shortening the entire manufacturing process. In addition, by reducing the number of times of attachment and detachment of the liquid containers, it is possible to reduce an adverse effect on the adjustment result due to the force or vibration acting on the adjustment member or the like when the liquid containers are attached and detached. Furthermore, by disposing at least one adjustment member at a position covered by the first liquid container, it is possible to downsize the container holding member or the like accordingly.

In the above-described method, the ejection mechanism may eject the liquid supplied from the second liquid container in the ejecting of the liquid.

According to this method, even if the ejection mechanism is driven to eject liquid from a liquid flow path corresponding to the first liquid container in a state in which the first liquid container is not mounted, gas flows into the liquid flow path corresponding to the first liquid container and there is a concern that the liquid is not ejected normally. In this way, as there is a possibility that adjustment by the adjustment member is hindered, the ejection mechanism ejects the liquid supplied from the second liquid container so that the adjustment by the adjustment member can be performed without any trouble based on the ejection result.

In addition, in the above-described method, it is desirable that the brightness of the liquid of the first liquid container is higher than the brightness of the liquid of the second liquid container.

According to this, the brightness of the liquid of the first liquid container removed from the container holding member in the adjusting of the liquid ejecting apparatus is higher than the brightness of the liquid of the second liquid container ejected from the ejection mechanism in the ejecting of the liquid. In other words, as the brightness of the liquid of the second liquid container is lower than the brightness of the liquid of the first liquid container, it is easier for an inspection personnel to visually recognize an ejection result in a case where the ejection result is visually inspected. Furthermore, even when the ejection result is inspected based on the image data thereof, the ejection result is easily recognized by a computer or the like. As a result, adjustment accuracy in the adjusting of the liquid ejecting apparatus based on the ejection result is improved.

Furthermore, in the above-described method, it is desirable that the liquid ejecting apparatus further includes a fastener (that is, fastening member) provided at a position not covered by the first liquid container and the second liquid container, and the adjusting of the liquid ejecting apparatus is performed by the fastening member and the adjustment member.

By this method, regardless of attachment and detachment of the first liquid container and the second liquid container, adjustment using the fastening member can be performed.

In addition, in the above-described method, it is desirable that the liquid ejecting apparatus includes a flow path member having a flow path for supplying the liquid from the first liquid container and the second liquid container to the ejection mechanism, the ejection mechanism includes a plurality of nozzle groups formed of the nozzles from which the liquid from the second liquid container is ejected, and alignment of the flow path member with respect to the container holding member is adjusted in the adjusting of the liquid ejecting apparatus.

According to this, a plurality of nozzle groups formed of the nozzles from which the liquid from the second liquid container is ejected are provided so that alignment of the flow path member with respect to the container holding member is adjusted more accurately based on the ejection result when the liquid is ejected from each nozzle group.

In addition, in the above-described method, it is desirable that a nozzle group to which the nozzle from which the liquid from the first liquid container is ejected belongs is sandwiched between the respective nozzle groups in which the liquid from the second liquid container is ejected.

According to this method, in the juxtaposition direction of the nozzle group, since an alignment deviation more conspicuously appears in the inspection pattern when the nozzle group from which the liquid from the second liquid container is ejected is positioned outside the nozzle group corresponding to the first liquid container, it is easier to specify the deviation of the alignment and the alignment can be adjusted with higher accuracy.

In the above-described method, the container holding member may be a carriage for reciprocally moving the flow path member, and the carriage and the flow path member may be fixed to each other in the adjusting of the liquid ejecting apparatus.

According to this method, it is possible to adjust the alignment of the flow path member with respect to the carriage.

Furthermore, in the above-described method, in the adjusting of the liquid ejecting apparatus, it is desirable to adjust a relative position between the carriage and the nozzle of the ejection mechanism.

According to this method, it is possible to align the position of the nozzle with respect to the carriage more accurately. As a result, landing accuracy of liquid ejected from the nozzle is improved.

In addition, in the above-described method, it is desirable to further include simultaneously sucking the liquid from the nozzles corresponding to the first liquid container and the second liquid container respectively to fill the liquid flow path of the ejection mechanism with the liquid from the second liquid container in a state in which a flow regulating member that regulates the flow of gas to the ejection mechanism is mounted on a connection portion with the first liquid container in the container holding member while the second liquid container is being mounted on the container holding member before the ejecting of the liquid.

According to this method, by mounting the flow regulating member on the connecting portion on which the first liquid container is mounted at the time of filling the liquid, it is possible to make the negative pressure due to the suction act more effectively on the liquid flow path of an object to be filled with the liquid, thereby smoothly performing the liquid filling operation more efficiently.

In addition, according to another aspect of the invention, there is provided a liquid ejecting apparatus including: a container holding member on which a first liquid container and a second liquid container are detachably mounted; an ejection mechanism for ejecting the liquid supplied from each of the liquid containers from a nozzle, and an adjustment member; and an adjustment member, in which the adjustment member is covered by the first liquid container while being disposed at a position not covered by the second liquid container.

According to this configuration, by disposing the adjustment member at a position covered by the first liquid container, it is possible to downsize the container holding member or the like accordingly.

In addition, in the above-described configuration, it is desirable that the ejection mechanism is configured to eject liquid from the second liquid container in a state in which the first liquid container is not mounted on the container holding member and the second liquid container is mounted on the container holding member in a case where a relative position between the container holding member and a fixed member to be fixed to the container holding member is adjusted by the adjustment member based on an ejection result when liquid is ejected by the ejection mechanism.

According to this configuration, since the ejection mechanism can eject liquid from the second liquid container without mounting the first liquid container, it is unnecessary to attach and detach the first liquid container in advance in performing the adjustment with the adjustment member.

In the above-described configuration, the container holding member may have a cover that covers at least a part of the first liquid container and the second liquid container, the adjustment member may be configured to be rotatable about a rotation axis, and the cover may have an opening on an extension line of an operation position for rotating the adjustment member in the rotation axis direction.

According to this configuration, since the adjustment member can be rotated and adjusted in a state in which the cover is closed, workability is improved.

In the above-described configuration, it is desirable that the liquid ejecting apparatus further includes the fastening member for fixing a carriage and a flow path member, in which the container holding member is the carriage for reciprocally moving the flow path member in a first direction, the fixed member is the flow path member having a flow path for supplying the liquid from the first liquid container and the second liquid container to the ejection mechanism, the adjustment member is used for adjusting alignment between the carriage and the flow path member, and the fastening member is provided at a position not covered by the first liquid container and the second liquid container.

According to this configuration, alignment can be adjusted using the adjustment member at a position covered by the first liquid container and the fastening member at a position not covered by the liquid container. Then, since the adjustment member is covered and protected by the liquid container except for the replacement operation of the liquid container or the like, application of an unintended external force to the adjustment member is suppressed. In this way, a positional deviation of the flow path member is suppressed after adjustment of alignment. In addition, regardless of attachment and detachment of the first liquid container and the second liquid container, alignment adjustment using the fastening member can be performed.

In the above-described configuration, it is desirable that the number of the adjustment members is less than the number of the fastening members.

According to this configuration, since the number of adjustment members covered by the liquid container is less than that of the fastening member, the number of liquid containers that need to be removed at the time of adjustment by the adjustment member can be reduced.

In the above-described configuration, it is desirable that adjustment members and fastening members are provided in a total of three or more and disposed in a nonlinear manner in which three or more adjustment members and fastening members are not arranged on the same straight line.

According to this configuration, since adjustment members and fastening members are provided in a total of three or more and disposed in a nonlinear manner in which three or more adjustment members and fastening members are not arranged on the same straight line, it is possible to stabilize the alignment between the carriage and the flow path member.

In the above-described configuration, the liquid ejecting apparatus may further include a flow path member having a flow path for supplying the liquid from the first liquid container and the second liquid container to the ejection mechanism, in which the flow path member may have an upstream member to which liquid is supplied from the first liquid container and the second liquid container and a downstream member to which liquid is supplied from the upstream member, the adjustment member and the fastening member are provided on the upstream member side to fix the upstream member and the carriage to each other, the upstream member may be longer than the downstream member in the first direction, and the fastening member may be disposed at a position away from the downstream member.

According to this configuration, it is possible to downsize the downstream member without being influenced by the increase in size of the liquid container.

In the above-described configuration, it is desirable that the fastening member is positioned closer to the downstream member side than the center of a protruding range among the protruding ranges of the upstream member away from the downstream member in the first direction.

According to this configuration, the fastening member is positioned closer to the downstream member side than the center of a protruding range among the protruding ranges of the upstream member away from the downstream member in the first direction so that the distance of the fastening member approaches as much as possible. In this way, even if warping occurs in the upstream member while improving the accuracy of alignment adjustment by disposing the fastening member in the protruding range of the upstream member, it is suppressed that the ejection mechanism is warped following the warping or the distance from the nozzle of the ejection mechanism to the landing target changes. As a result, it is suppressed that the result of the alignment adjustment is changed.

In the above-described configuration, it is desirable that the ejection mechanism has a plurality of nozzle groups formed of nozzles from which the liquid from the second liquid container is ejected, and a nozzle group to which the nozzle from which the liquid from the first liquid container is ejected belongs is sandwiched between the respective nozzle groups in which the liquid from the second liquid container is ejected.

According to this configuration, it is easier to specify the amount of the alignment deviation and the alignment can be adjusted with higher accuracy when the nozzle group from which the liquid from the second liquid container is ejected is positioned outside the nozzle group corresponding to the first liquid container in the juxtaposition direction of the nozzle group.

In addition, in the above-described configuration, it is desirable that the brightness of the liquid of the first liquid container is higher than the brightness of the liquid of the second liquid container.

According to this configuration, as the brightness of the liquid of the first liquid container is higher than the brightness of the liquid of the second liquid container, in other words, as the brightness of the liquid of the second liquid container is lower than the brightness of the liquid of the first liquid container, it is easier for an inspection personnel to visually recognize an ejection result by the ejection mechanism in a case where the ejection result is visually inspected. Furthermore, even when the ejection result is inspected based on the image data thereof, the ejection result is easily recognized by a computer or the like. As a result, adjustment accuracy in the alignment adjustment based on the ejection result is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for carrying out the invention will be described with reference to the accompanying drawings. In the embodiment which will be described below, various limitations have been made as preferred specific examples of the invention, but the scope of the invention is not limited to these embodiments unless there is a statement to limit the invention, particularly in the description below. In addition, in the following, as the liquid ejecting apparatus of the invention, an ink jet recording apparatus (hereinafter, a printer) will be described as an example.

Figure 1:
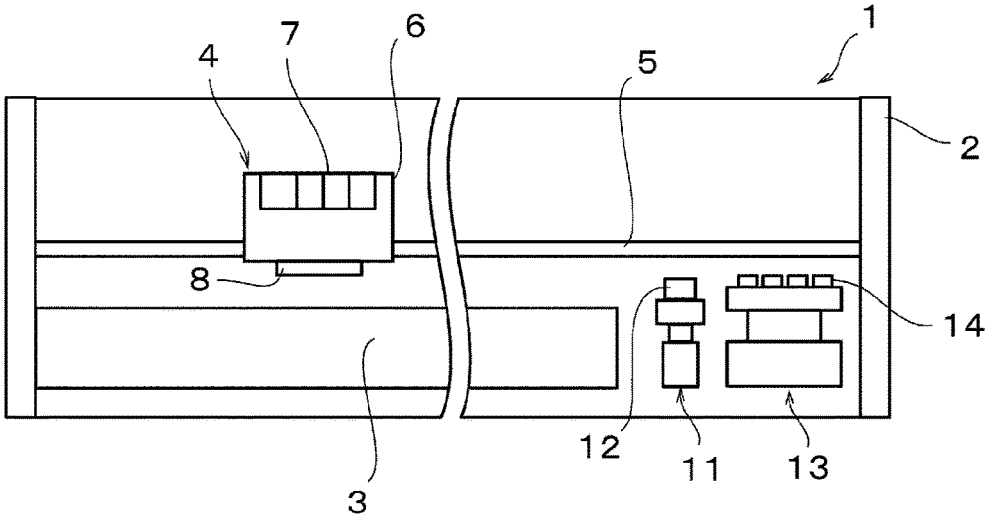
FIG. 1 is a front view for explaining a configuration of a printer.

FIG. 1 is a front view showing a configuration of a printer 1 on which a head unit 4 is mounted. The printer 1 includes a frame 2 and a platen 3 disposed inside the frame 2, and a recording medium such as recording paper, cloth or resin sheet (a kind of landing target of liquid) is transported on the platen 3 by a transport mechanism (not shown). In addition, inside the frame 2, a guide rod 5 is installed parallel to the platen 3, and a carriage 6 accommodating the recording head 8 is slidably supported on the guide rod 5. The carriage 6 is configured to reciprocally move in a main scanning direction (the first direction) that intersects a sub-scanning direction (a second direction) which is a transporting direction of the recording medium along the guide rod 5 by the driving of a carriage moving mechanism (not shown). The head unit 4 is configured by mounting the recording head 8 on the carriage 6. The printer 1 ejects ink (a kind of liquid in the invention) from nozzles 34 (see FIG. 5) of the recording head 8 while relatively moving the carriage 6 in the main scanning direction with respect to the recording medium mounted on the platen 3 to form (record/print) landing patterns of characters, images, and the like by causing the ink to land on the recording medium.

An ink cartridge 7 (a kind of liquid container) storing ink is detachably mounted on the carriage 6 (a kind of container holding member in the invention). As the ink, various well-known compositions can be used, for example, aqueous dye ink or pigment ink, organic solvent type (eco-friendly solvent type) ink having higher weather resistance than these aqueous ink, photocuring type ink which is cured by irradiation of ultraviolet light, and the like. In the embodiment, the configuration in which the ink cartridge 7 is mounted on the carriage 6 is exemplified, but the invention is not limited thereto. A configuration in which the ink cartridge 7 is disposed on the main body side of the printer 1 and is supplied to the recording head 8 via an ink supply tube (an off-carriage type) can also be adopted. In this configuration, a member called a sub-tank (a kind of liquid container) is mounted on the carriage 6, and ink from an ink cartridge is supplied to the sub-tank, and then the ink is supplied from the sub-tank to the recording head 8. The sub-tank has a function of adjusting a supply pressure of ink to be supplied to the recording head 8 to be constant. Alternatively, a kind of ink supply tube liquid container may be directly connected to the connecting portion of an ink introduction needle 24 of the recording head 8 mounted on the carriage 6.

In the home position which is a non-recorded area of the printer 1, a wiping mechanism 11 is disposed to remove the nozzle forming surface (a surface facing the platen 3, see FIG. 8 and the like.) of the recording head 8 mounted on the carriage 6. The wiping mechanism 11 has a wiper 12, and the wiper 12 is made of a member having elasticity and flexibility, such as rubber or elastomer. In addition, it is also possible to adopt a structure in which the surface of an elastic blade body is covered with cloth. The wiping mechanism 11 places a tip of the wiper 12 at a position where the wiper 12 can come in contact with the nozzle forming surface of the recording head 8 during wiping. Then, by relatively moving the tip of the wiper 12 in contact with the nozzle forming surface, the nozzle forming surface is wiped by the wiper 12.

Adjacent to the above-described wiping mechanism 11, a capping mechanism 13 is disposed at or near the home position. The capping mechanism 13 has a cap 14 made of a tray-like elastic member capable of abutting on the nozzle forming surface of the recording head 8. In the capping mechanism 13, the space inside the cap 14 functions as a sealed space portion, and the cap 14 can be brought into close contact with the nozzle forming surface in a state in which the space inside the cap 14 faces a nozzle 34 of the recording head 8 in the sealed space portion. That is, the nozzle 34 is positioned in the space covered with the cap 14 which is in close contact with the nozzle forming surface and the nozzle forming surface. In addition, a pump unit is connected to the cap 14 via a drain tube, and the pressure inside the sealed space portion of the cap 14 can be made negative by an operation of the pump unit. Then, in initial filling processing of filling the flow path inside the recording head 8 with ink from the ink cartridge 7 or cleaning processing for eliminating the clogging of the nozzles 34 and an ink flow path of the recording head 8, when the pump unit is operated in a state in which the cap 14 is in close contact with the nozzle forming surface and the pressure inside the sealed space portion is made negative, ink and air bubbles are discharged into the sealed space portion of the cap 14 by suction from the nozzle 34. The cap 14 in the embodiment is provided separately for each ejection unit 23 of the recording head 8. Accordingly, at the time of the initial filling processing or the like, it is possible to simultaneously perform suction from the nozzles 34 of all the nozzle arrays 49, or selectively suction for each ejection unit 23. It is possible to adopt a configuration in which only one cap 14 having a size enough to seal the nozzle forming surface of one ejection unit 23 is provided and suction is sequentially performed for each ejection unit 23 using the cap 14. In addition, in the above-described off-carriage type, a configuration in which an ink supply path on the upstream side (the ink cartridge 7 side) than the recording head 8 is pressurized by, for example, an air pump so as to pressurize the inside of the flow path of the recording head 8 to perform the above initial filling processing or cleaning processing.

Figure 2:
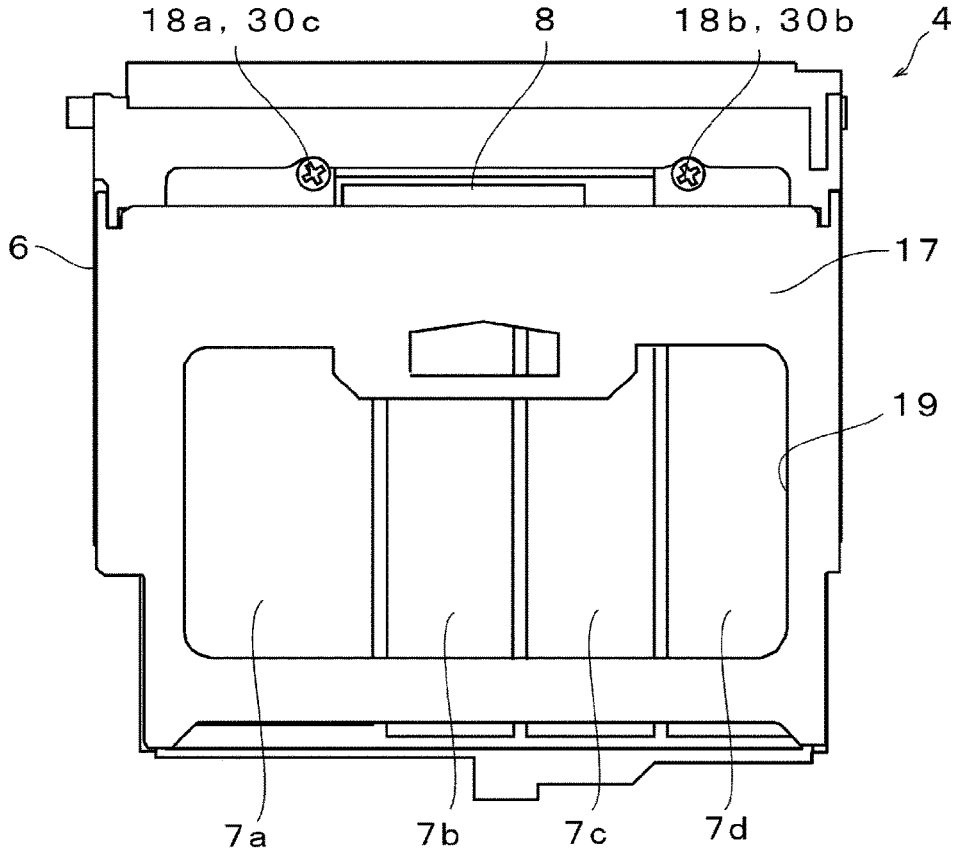
FIG. 2 is a top view for explaining a configuration of a head unit.
Figure 3:
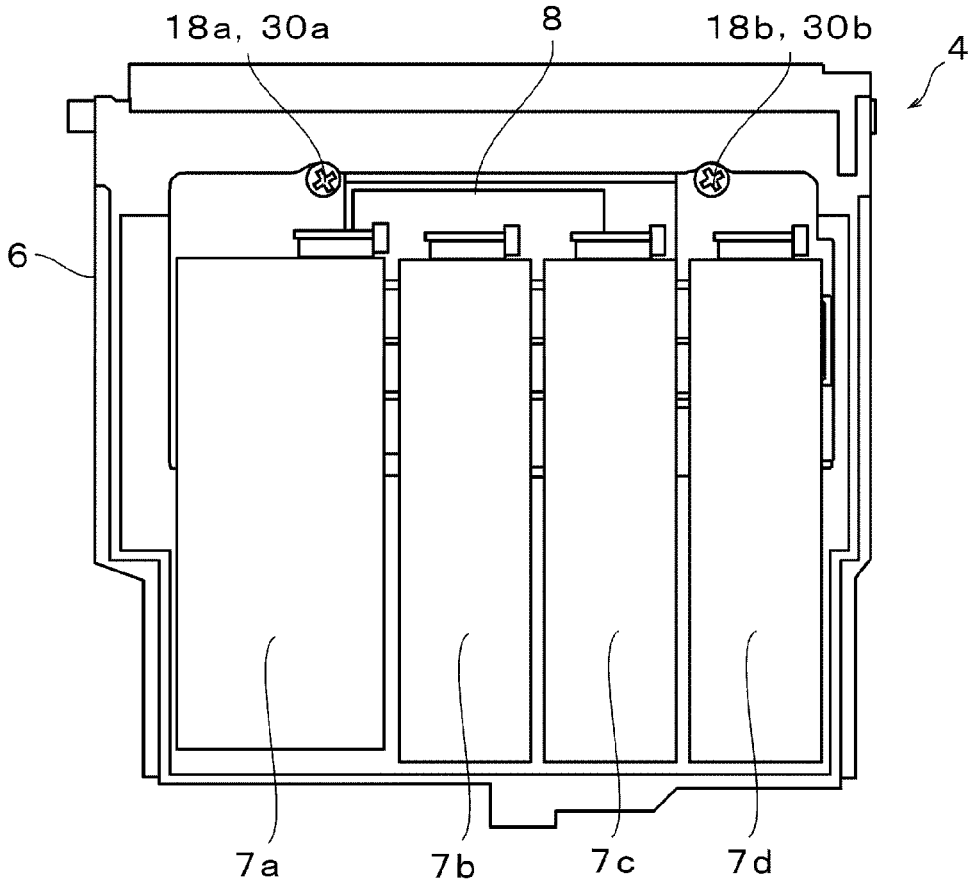
FIG. 3 is a top view for explaining a configuration of the head unit in a state in which a cover is removed.
Figure 4:
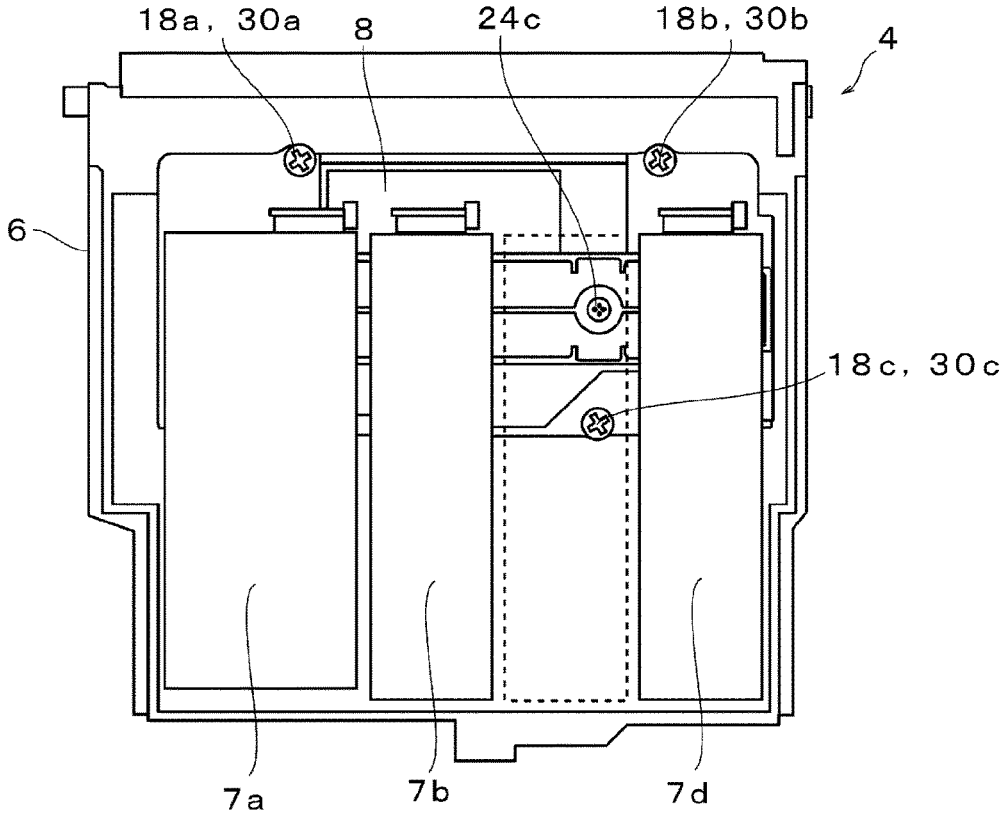
FIG. 4 is a top view for explaining a configuration of the head unit in a state in which a third ink cartridge is removed.

FIG. 2 is a top view of the head unit 4 in a state in which a cover 17 is closed, and FIG. 3 is a top view of the head unit 4 in a state in which the cover 17 is removed. In addition, FIG. 4 is a top view of the head unit 4 in a state in which the cover 17 is removed and a third ink cartridge 7*c* is removed. The head unit 4 in the embodiment is configured by attaching the recording head 8 and the ink cartridge 7 to the carriage 6. The carriage 6 in the embodiment is a box-like member having an open upper surface (a surface on a side opposite to the platen 3 side), and is made of, for example, a synthetic resin or the like. The bottom (bottom plate) of the carriage 6 is provided with an insertion opening (not shown). While only a main body portion 22*b* (described later) of a holder 22 in the recording head 8 can be inserted through the insertion opening, the insertion opening has a shape and dimensions so that an ink introduction member 21 (a kind of fixed member in the invention) and a flange portion 22*a* of the holder 22 cannot be inserted. In this way, when the recording head 8 is disposed in the inner space of the carriage 6, while the main body portion 22*b* of the holder 22 is exposed to the outside (a lower surface side) of the carriage 6 through the insertion opening, since the ink introduction member 21 and the flange portion 22*a* of the holder 22 cannot pass through the insertion opening, the ink introduction member 21 and the flange portion 22*a* of the holder 22 are seated on the upper surface of the bottom plate of the carriage 6. Screw holes (not shown) corresponding to adjustment holes 20*a* to 20*c* which will be described later are formed in a total of three in the disposition position of the ink introduction member 21 in the carriage 6, respectively. Then, as described later, alignment adjustment is performed for the recording head 8 disposed on the carriage 6, a fastening member 18 such as a screw (which is a kind of fastening member in the invention and a kind of adjustment member in a broad sense) is screwed into the screw hole through an adjustment hole 20 and fixed (fastened).

The ink cartridge 7 is detachably mounted on the carriage 6 to which the recording head 8 is fixed so as to be superimposed on an upper portion of the recording head 8. In the embodiment, ink cartridges 7*a* to 7*d* of four colors in total (for example, cyan (C), magenta (M), yellow (Y), and black (K)) are mounted on the carriage 6, respectively. In the embodiment, black ink is stored in the first ink cartridge 7*a*, magenta ink in the second ink cartridge 7*b*, yellow ink in the third ink cartridge 7*c* (corresponding to the first liquid container in the invention), and cyan ink in the fourth ink cartridge 7*d* (corresponding to the second liquid container in the invention), respectively. Among them, the dimensions of the first ink cartridge 7*a* in the first direction (a cartridge juxtaposition direction) are designed to be larger than the dimensions of the other ink cartridge 7 in the first direction. For this reason, the capacity of the first ink cartridge 7*a* is larger than the capacity of the other ink cartridge 7.

In the carriage 6 in the embodiment, the cover 17 is provided so as to be opened and closed. In a state in which the cover 17 is closed, each ink cartridge 7 mounted on the carriage 6 is partially covered and pressed toward the bottom side of the carriage 6 so that the ink cartridge 7 is reliably mounted on the carriage 6. In this way, the carriage is configured to prevent the connection with the recording head 8 from becoming insufficient or being accidentally detached. An opening 19 is formed on the cover 17 and a part of the upper surface of the ink cartridge 7 is configured to be exposed inside the opening 19 in a state in which the cover 17 is closed. In addition, as will be described later, at the time of alignment adjustment, the third ink cartridge 7*c* is removed and the fastening member 18 (18*c*) can be exposed in a state in which the cover 17 is closed (see FIG. 10). The shape of the opening 19 is not limited to what is illustrated. In brief, the opening 19 may have any shape as long as the opening 19 is open on an extension line in the rotation axis direction of the fastening member 18 at an operation position (a position (force point) on which a force for rotating act) for rotating the fastening member 18 (or an adjustment member 30) configured to be rotatable about the rotation axis. In addition, the periphery of the opening 19 does not have to be surrounded by the material of the cover 17, and for example, may be a notch.

Figure 5:
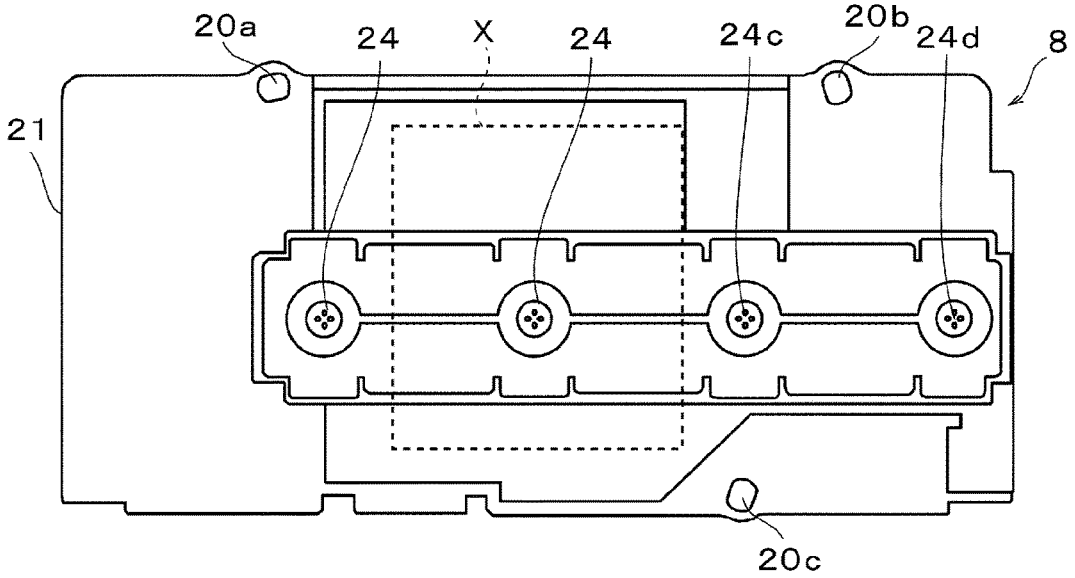
FIG. 5 is a top view for explaining a configuration of a recording head.
Figure 6:
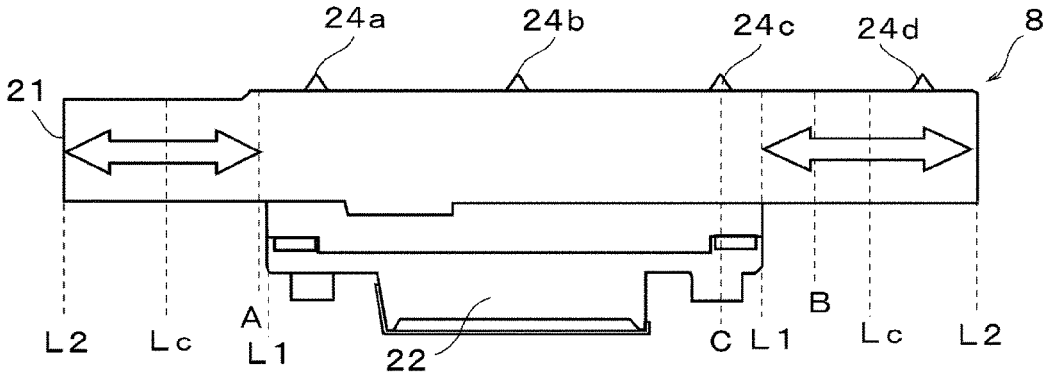
FIG. 6 is a front view for explaining the configuration of the recording head.
Figure 7:
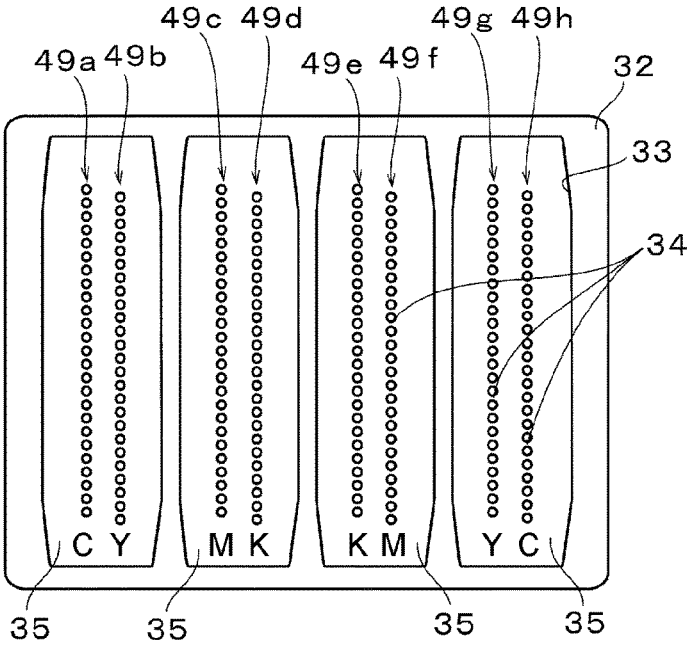
FIG. 7 is a plan view for explaining a configuration of a nozzle forming surface of the recording head.
Figure 8:
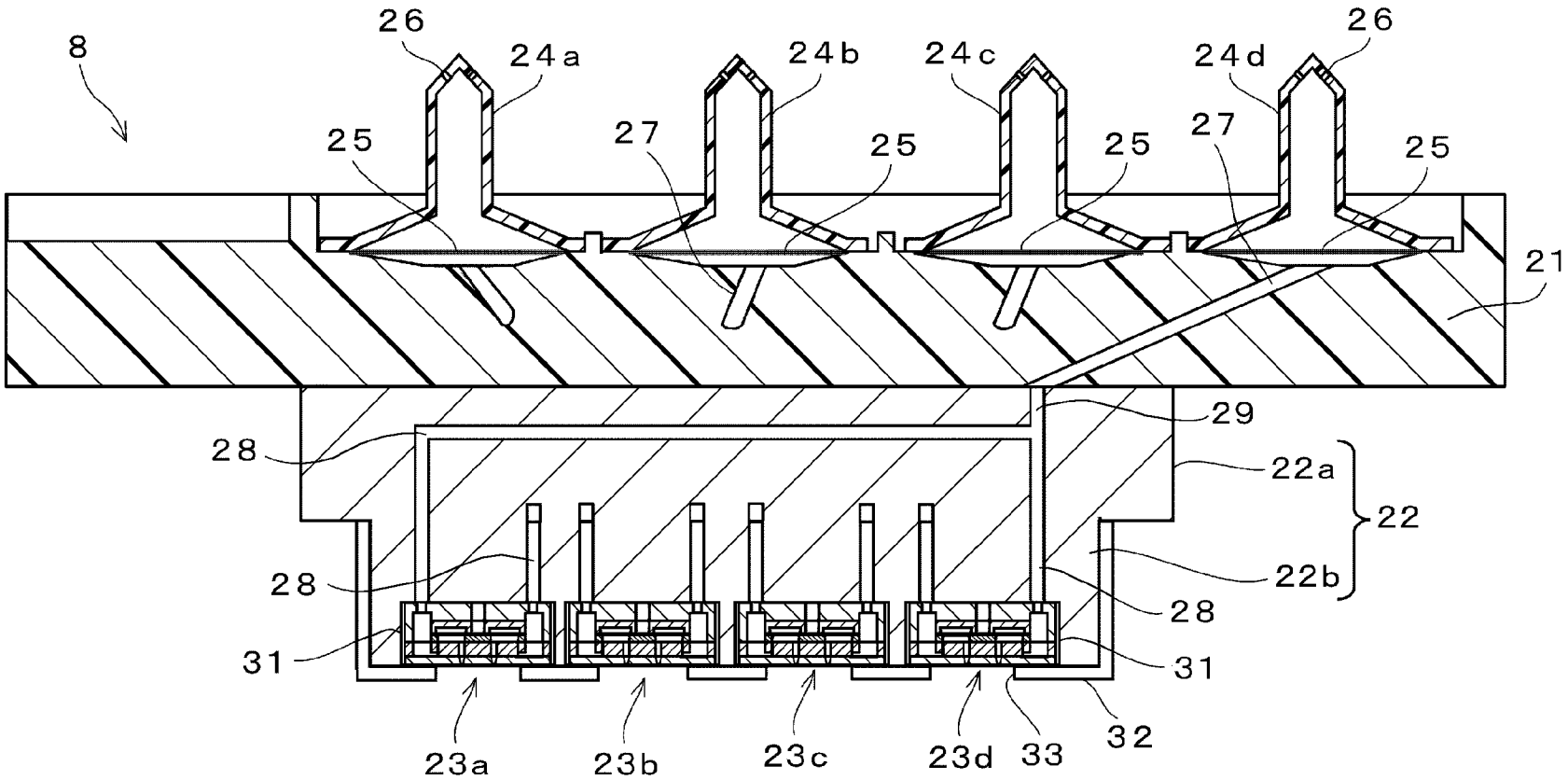
FIG. 8 is a sectional view of the recording head.
Figure 9:
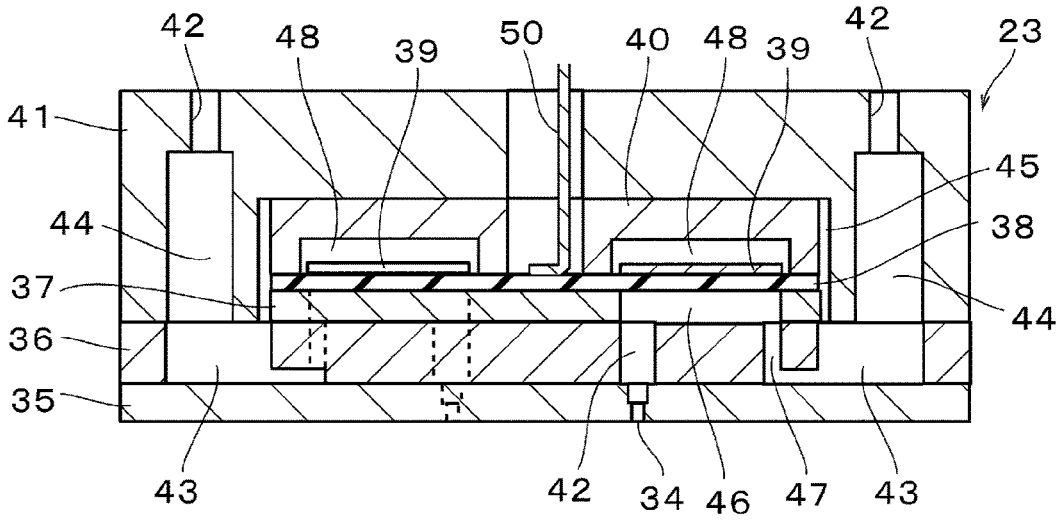
FIG. 9 is a sectional view of an ejection unit.

FIG. 5 is a top view of the recording head 8, and FIG. 6 is a front view of the recording head 8. In addition, FIG. 7 is a plan view for explaining the configuration of the nozzle forming surface of the recording head 8. Furthermore, FIG. 8 is a sectional view of the recording head 8. In FIG. 5, a range X indicated by a broken line shows the range of the nozzle forming surface. In addition, FIG. 8 mainly shows the flow path from a second ink introduction needle 24*b* where the ink (cyan ink) from the fourth ink cartridge 7*d* is introduced to the ejection unit 23, and the flow path into which the ink from the other ink cartridge 7 is introduced communicates with each of the ejection units 23 through different positions in a depth direction of FIG. 8. The recording head 8 in the embodiment includes the ink introduction member 21 (a kind of flow path member or upstream member in the invention), the ejection unit 23 (a kind of ejection mechanism in the invention), and the holder 22 (a kind of flow path member or downstream member in the invention), in which the ink introduction member 21, the ejection unit 23, and the holder 22 are stacked. In the following, for the sake of convenience, a stack direction of each member will be described as an up-down direction.

The ink introduction member 21 in the embodiment is a member disposed on an upper portion of the recording head 8 and is formed to be longer in the main scanning direction than the holder 22 so that the ink cartridges 7*a* to 7*d* can be disposed on the upper surface side. On the upper surface of the ink introduction member 21, a plurality of ink introduction needles 24 are provided with a filter 25 interposed therebetween. The ink introduction needle 24 is provided for each ink type (color). In the embodiment, a total of four ink introduction needles 24*a* to 24*d* corresponding to the four ink cartridges 7*a* to 7*d* are juxtaposed along the main scanning direction. Both the ink introduction member 21 and the ink introduction needle 24 are made of a synthetic resin. In addition, the filter 25 is a member that filters the ink introduced from the ink introduction needle 24. For example, a member on which metal is knitted in a mesh form or a member in which a large number of holes are formed a thin metal plate or the like is used. The filter 25 captures foreign material and air bubbles in the ink. Then, in the embodiment, when the ink cartridge 7 is mounted on the carriage 6, the ink introduction needle 24 is configured to be inserted into the ink cartridge 7. That is, the ink introduction needle 24 functions as a part of a connection portion with the ink cartridge 7 in the carriage 6. Then, the ink inside the ink cartridge 7 is introduced from an introduction hole 26 (FIG. 8) provided at a tip of the ink introduction needle 24 to an internal flow path. When ink is introduced from the ink introduction needle 24, the ink passes through an introduction flow path 27 formed inside the ink introduction member 21 after passing through the filter 25 and is supplied to a supply flow path 28 of the holder 22 disposed below the ink introduction member 21 via a flow path connection portion 29. In the ink introduction member 21 in the embodiment, a configuration in which the needle-like ink introduction needle 24 is inserted into the ink cartridge 7 to introduce ink, but the invention is not limited thereto. For example, a porous material such as a non-woven fabric or a sponge is disposed on an ink introduction part of the ink introduction member 21, a similar porous material is correspondingly provided also in an outlet part of the liquid container such as an ink cartridge and a sub-tank, and the both porous members are brought into contact with each other so that a so-called foam type configuration in which liquid is exchanged by a capillary phenomenon can be adopted.

As shown in FIG. 5, in the ink introduction member 21, the adjustment holes 20 through which the fastening member 18 for fixing the ink introduction member 21 to the carriage 6 is inserted are formed at a total of three positions corresponding to the screw holes of the carriage 6. Specifically, a first adjustment hole 20*a* and a second adjustment hole 20*b* are formed on one side in the sub-scanning direction (the upper side in FIG. 5) at intervals along the main scanning direction (a longitudinal direction of the ink introduction member 21). In addition, a third adjustment hole 20*c* is formed on the other side (the lower side in FIG. 5) in the sub-scanning direction. In this way, among the adjustment holes 20*a* to 20*c* (and fastening members 18*a* to 18*c* inserted through and being combined with these adjustment holes 20*a* to 20*c*), two sets are disposed on one side of the ink introduction member 21 in the sub-scanning direction along the longitudinal direction of the ink introduction member 21, and the remaining one set is disposed on the other side of the ink introduction member 21 in the sub-scanning direction so that these three sets are disposed in a nonlinear manner (a triangular shape in a plan view) in which the sets are not aligned on the same straight line. Then, since an imaginary plane passing through these three sets is uniquely defined by adopting such a layout, it is possible to stabilize the alignment between the ink introduction member 21 (the recording head 8) and the carriage 6.

Each of the adjustment holes 20*a* to 20*c* is an elongated hole that is set to be longer than a shaft diameter of the fastening member 18 in a predetermined direction. The longitudinal directions of the adjustment holes 20*a* to 20*c* are different from each other. For example, the longitudinal direction of the first adjustment hole 20*a* is inclined in the range of 10° to 20° with respect to the main scanning direction. Similarly, the longitudinal direction of the second adjustment hole 20*b* is inclined in the range of 10° to 20° with respect to the sub-scanning direction, and the longitudinal direction of the third adjustment hole 20*c* is inclined in the range of about −10° to −20° (340° to 350°) with respect to the sub-scanning direction. By configuring in this way, adjustment (alignment adjustment) of the arrangement position of the ink introduction member 21 with respect to the carriage 6 can be performed. That is, in a state in which the recording head 8 is disposed on the carriage 6 and the fastening members 18*a* to 18*c* are passed through the adjustment holes 20*a* to 20*c*, respectively, and temporarily held in the screw holes, that is, in a state in which the ink introduction member 21 can be moved within the range of the gap formed between the adjustment hole 20 and an axis of the fastening member 18, the position of the ink introduction member 21 with respect to the carriage 6, that is, the position of the recording head 8 in the main scanning direction and the sub-scanning direction, and the inclination with respect to each direction can be finely adjusted.

Then, after adjustment of the alignment, the ink introduction member 21 is fixed to the carriage 6 by the fastening members 18*a* to 18*c* so that the recording head 8 can be fixed to the carriage 6 in a state in which the alignment is adjusted. That is, in the embodiment, the adjustment holes 20*a* to 20*c* and the fastening members 18*a* to 18*c* function as adjustment members in a broad sense (a difference between an adjustment member in a broad sense and an adjustment member in a narrow sense will be described later) relating to alignment adjustment. That is, the combination of the adjustment hole 20 and the corresponding fastening member 18 is the adjustment member 30 for adjusting relating to ejection of the ink of the ejection unit 23. The adjustment member 30 also serves as a fastening member. Then, in the embodiment, in order to adjust the alignment, in operations of loosening or tightening the fastening members 18*a* to 18*c* of each of adjustment members 30*a* to 30*c*, or in a state in which the fastening member 18 is loosened, the operation of adjusting the position of the ink introduction member 21 (the recording head 8) with respect to the carriage 6 corresponds to adjustment of the liquid ejecting apparatus performed by the adjustment member in the invention.

These adjustment members 30*a* to 30*c* are disposed at positions outside the nozzle forming surface of the recording head 8 when viewed in the stack direction (a direction orthogonal to the nozzle forming surface) of the constituent members of the head unit 4 in the ink introduction member 21. Then, a first adjustment member 30*a* and a second adjustment member 30*b* which are disposed at positions not covered by the ink cartridge 7 but are arranged along the main scanning direction among the adjustment members 30*a* to 30*c*, are respectively positioned within the range of the holder 22 side (a range from L1 to Lc) than the center (the position indicated by Lc in FIG. 6) of the projection range (the range indicated by outlined arrows in FIG. 6 and ranging from L1 corresponding to a side end of the holder 22 in the main scanning direction to L2 corresponding to a side end of the ink introduction member 21) projecting outward from the holder 22 of the ink introduction member 21 in the main scanning direction as shown in FIG. 6. In addition, a third adjustment member 30*c* is formed in a range between the first adjustment member 30*a* and the second adjustment member 30*b* in the main scanning direction. Then, as shown in FIG. 4 and the like, on the upper surface of the recording head 8 disposed on the carriage 6, the third adjustment member 30*c* is disposed at a position covered by the third ink cartridge 7*c*, that is, a position that cannot be accessed by an adjustment tool such as a driver for loosening or tightening the fastening member 18*c* (to perform adjustment necessary for position adjustment or fixing of the adjustment member 30) by the third ink cartridge 7*c* at the time of alignment adjustment. The position is a position not covered by the other ink cartridge 7 such as the second ink cartridge 7*b*. In FIG. 6, the position of the first adjustment member 30*a* is represented by A, the position of the second adjustment member 30*b* is represented by B, and the position of the third adjustment member 30*c* is represented by C, respectively.

In this way, by placing the first adjustment member 30*a* and the second adjustment member 30*b* aligned in the longitudinal direction of the ink introduction member 21 in the protruding range, the adjustment members 30*a* and 30*b* are disposed close to the holder 22. That is, the distance between two adjustment holes 20*a* and 20*b*, and the fastening member 18 is relatively close. In this way, even if warping occurs in the ink introduction member 21 by any chance while improving the accuracy of alignment adjustment which will be described later, it is suppressed that the ejection unit 23 is warped following the warping, in particular, the nozzle forming face is prevented from being around or the distance from the nozzle to the recording medium is prevented from changing. As a result, it is suppressed that the result of the alignment adjustment is changed. In addition, by disposing at least one of the adjustment members 30 at a position covered by the ink cartridge 7, compared with a configuration in which all of the adjustment members are disposed at positions (positions where the adjustment tool or the like can access in a state in which the ink cartridge is mounted) not covered by the ink cartridge, the carriage 6, the recording head 8, and the head unit 4 can be downsized accordingly. In addition, it is easier to perform adjustment using the adjustment member 30 regardless of whether the ink cartridge 7 is attached or detached, as compared with the configuration in which all of the adjustment members are disposed at positions covered by the ink cartridge.

The holder 22 is a member having the supply flow path 28 for guiding the ink introduced from the ink introduction needle 24 to the ejection unit 23 side or a circuit substrate (not shown) for handling an electric signal of a driving signal for driving a piezoelectric element 39 of each ejection unit 23. In FIG. 8, the supply flow path 28 is formed in the holder 22 itself, but it is not limited thereto. It is also possible to adopt a configuration in which the supply flow path 28 is formed in the flow path member (a member separate from the holder 22) accommodated in the holder 22. The holder 22 in the embodiment has the flange portion 22*a* on the ink introduction member 21 side and a main body portion 22*b* on the downstream side thereof. The flange portion 22*a* is a member formed larger than the main body portion 22*b* in the main scanning direction and smaller than the ink introduction member 21 in the dimensions thereof. Inside the holder 22, the supply flow path 28 is provided corresponding to each of the ink introduction needles 24. Each supply flow path 28 branches into two in the middle and communicates with a corresponding introduction port 42 of the ejection unit 23. In this way, in the main scanning direction (a juxtaposition direction of the ink cartridge 7), the dimensions of the holder 22 are set to be smaller than the dimensions of the ink introduction member 21 so that downsizing of the holder 22 is achieved without being influenced by the increase in the capacity of the ink cartridge 7. In this way, the head unit 4 can contribute to downsizing and weight saving as a whole.

On the lower surface side of the holder 22, a plurality of accommodating space portions 31 which are a space capable of accommodating the ejection unit 23 are partitioned. The lower surface side (a side facing the recording medium during a printing operation) of the accommodating space portion 31 is open, and the ejection unit 23 joined to a fixing plate 32 from the opening is accommodated. The fixing plate 32 is made of a metal plate such as stainless steel, for example. The lower surface (a nozzle plate 35 or a member disposed around the nozzle plate 35) of each ejection unit 23 is joined to the fixing plate 32 so that a height direction (a position in the direction perpendicular to the nozzle plate 35) of these ejection units 23 is defined. In addition, an opening portion 33 corresponding to each of the ejection units 23 is formed in the fixing plate 32. As described above, in a state in which the lower surface of each ejection unit 23 is joined to the fixing plate 32, the areas where the nozzles 34 of the nozzle plate 35 of each ejection unit 23 are formed are exposed in the opening portion 33, respectively. When the ejection unit 23 is accommodated in the accommodating space portion 31 of the holder 22 in a state of being positioned, the flow path inside the unit including the nozzle 34 or a pressure chamber 46 of the ejection unit 23 communicates with the supply flow path 28. The ink introduced from the ink cartridge 7 through the ink introduction needle 24, fills the ink flow path (a kind of liquid flow path) through the introduction flow path 27 and the supply flow path 28 to the nozzle 34 of the ejection unit 23 after being filtered by the filter 25.

The ejection unit 23 in the embodiment is attached to a unit case 41 joined with an adhesive or the like in a state in which the nozzle plate 35, a communication substrate 36, a pressure chamber forming substrate 37, a diaphragm 38, the piezoelectric element 39, and a protective substrate 40 are stacked. The unit case 41 is a member formed with the introduction port 42 for introducing ink from the ink cartridge 7 side and a case flow path 44 for introducing ink introduced from the introduction port 42 to a common liquid chamber 43 side. On the lower surface side of the unit case 41, a storage space portion 45 recessed in a rectangular parallelepiped shape from the lower surface to the middle of the unit case 41 in the height direction is formed. The storage space portion 45 is a space for accommodating the pressure chamber forming substrate 37, the diaphragm 38, the piezoelectric element 39, and the protective substrate 40. In this accommodation state, the upper surface of the communication substrate 36 is joined to the lower surface of the unit case 41.

The pressure chamber forming substrate 37 in the embodiment is made of, for example, a silicon substrate. In the pressure chamber forming substrate 37, a plurality of pressure chamber space portions that partition the pressure chamber 46 are formed by anisotropic etching corresponding to each of the nozzles 34 of the nozzle plate 35. The opening portion on one (an upper surface side) of the pressure chamber space portion in the pressure chamber forming substrate 37 is sealed by the diaphragm 38. In addition, the communication substrate 36 is joined to the surface of the pressure chamber forming substrate 37 opposite to the diaphragm plate 38 and the other opening of the pressure chamber space portion is sealed by the communication substrate 36. In this way, the pressure chamber 46 is partitioned and formed. The pressure chamber 46 communicates with the nozzle 34 via a nozzle communication port 42 and communicates with the common liquid chamber 43 via an individual communication port 47. Then, a plurality of pressure chambers 46 are juxtaposed in correspondence with each of the nozzles 34. The communication substrate 36 is a plate material made of a silicon substrate similarly to the pressure chamber forming substrate 37. In the communication substrate 36, a space portion to be a common liquid chamber 43 (also called a reservoir or a manifold) commonly provided in a plurality of pressure chambers 46 of the pressure chamber forming substrate 37 is formed by anisotropic etching. The common liquid chamber 43 is a long space portion along the juxtaposition direction in which each pressure chamber 46 is disposed. The pressure chamber forming substrate 37 and the diaphragm 38 may be integrally formed, or may be separately formed. In addition, the communication substrate 36 may not be provided and the nozzle communication port 42 may be formed in the pressure chamber forming substrate 37.

As shown in FIG. 7, the nozzle plate 35 of each ejection units 23 is a plate material in which a plurality of nozzles 34 are opened in a row. In the embodiment, a plurality of nozzles 34 are provided at a predetermined pitch to form the nozzle arrays 49 (corresponding to a nozzle group in the invention). The nozzle plate 35 is made of, for example, a silicon substrate, and the cylindrical nozzle 34 is formed on the substrate by dry etching. In the embodiment, since a total of two rows of the nozzle arrays 49 are formed on the nozzle plate 35 of each ejection unit 23, respectively and a total of four ejection units 23 are provided in the recording head 8, a total of eight rows of nozzle arrays 49*a* to 49*h* are juxtaposed in the recording head 8 in the main scanning direction. Then, two rows of the nozzle arrays 49 correspond to each of the ink cartridges 7 mounted on the carriage 6, respectively. More specifically, the cyan ink of the fourth ink cartridge 7*d* is allocated to a first nozzle array 49*a* and an eighth nozzle array 49*h* positioned at both ends of the nozzle array 49. This cyan ink is ink used to form the inspection pattern which will be described later. Similarly, the yellow ink of the third ink cartridge 7*c* is allocated to a second nozzle array 49*b* and a seventh nozzle array 49*g*, the magenta ink of the second ink cartridge 7*b* to a third nozzle array 49*c* and a sixth nozzle array 49*f*, and the black ink of the first ink cartridge 7*a* to a fourth nozzle array 49*d* and a fifth nozzle array 49*e*, respectively.

In the embodiment, the first nozzle array 49*a* and the eighth nozzle array 49*h* corresponding to the cyan ink used for forming the inspection pattern are laid out so as to sandwich the second nozzle array 49*b* and the seventh nozzle array 49*g* corresponding to the ink (yellow ink) of the ink cartridge 7*c* detached at least at the time of alignment adjustment, therebetween. In this way, as a plurality of nozzle arrays 49 for ejecting the cyan ink used for forming the inspection pattern are provided, it is possible to more accurately perform alignment adjustment which will be described later based on the inspection pattern which is an ejection result when ink is ejected from each of the nozzle arrays 49*a* to 49*h*. In addition, since the first nozzle array 49*a* and the eighth nozzle array 49*h* corresponding to the cyan ink used for forming the inspection pattern are disposed outside the second nozzle array 49*b* and the seventh nozzle array 49*g* corresponding to the ink of the ink cartridge 7*c* to be removed at the time of alignment adjustment in a nozzle array juxtaposition direction (more outside with reference to the center position of the arrangement of each of the nozzle arrays 49), and the deviation of the alignment appears more conspicuously in the inspection pattern in a case where there is an alignment deviation in the recording head 8, it is easier to specify the amount of the alignment deviation based on the inspection pattern, and the alignment can be adjusted with higher accuracy. The nozzle arrays 49 corresponding to the ink used for forming the inspection pattern are not necessarily positioned at both ends of the nozzle array 49 in the juxtaposition direction, and other nozzle arrays 49 may be positioned outside the nozzle array 49 in the nozzle array juxtaposition direction. In addition, relating to the nozzle arrays 49 corresponding to the ink cartridges 7 to be removed at the time of alignment adjustment, a part of the nozzle arrays 49 may not be sandwiched between the nozzle arrays 49 corresponding to the ink used for forming the inspection pattern. For example, one of the two rows of the nozzle arrays 49 corresponding to the ink cartridges 7 to be removed at the time of alignment adjustment may be sandwiched between the nozzle arrays 49 corresponding to the ink used for forming the inspection pattern, and the other nozzle arrays 49 may not be sandwiched between the nozzle arrays 49 corresponding to the ink used for forming the inspection pattern.

It is desirable that at least two rows of the nozzle arrays 49 corresponding to the ink used for forming the inspection pattern are provided, but for the ink of other colors, two rows of the nozzle arrays 49 may not be necessarily allocated. That is, it is also possible to adopt a configuration in which one nozzle array 49 is allocated for each color ink other than the ink for forming the inspection pattern or a configuration in which three or more nozzle arrays 49 are allocated to each color ink. In addition, the number of the nozzle arrays 49 allocated to the ink of each color is not necessarily the same. For example, a plurality of nozzle arrays 49 may be allocated to the ink used for forming the inspection pattern, and the nozzle array 49 may be allocated to each of the other ink one by one. In addition, a plurality of types (a plurality of colors) of ink may be allocated to the same nozzle array 49. In addition, in the embodiment, ink is supplied from one fourth ink cartridge 7*d* to the ink flow path of the recording head 8 and is supplied to the first nozzle array 49*a* and the eighth nozzle array 49*h* by branching the ink flow path in the middle, but for example, the ink cartridge 7 and the nozzle array 49 may be configured to correspond one-to-one. For example, in the case of using black ink as the inspection pattern, in a configuration in which two nozzle arrays 49 for ejecting the ink are provided, two ink cartridges 7 storing the black ink are provided in the same number as the nozzle arrays 49. In addition, the inspection pattern may be formed with only one row of the nozzle array 49, or the inspection pattern may be formed with two rows of the nozzle arrays 49.

The diaphragm 38 formed on the upper surface of the pressure chamber forming substrate 37 is made of, for example, silicon dioxide having a thickness of about 1 μm. In addition, on this diaphragm 38, an insulating film (not shown) is formed. This insulating film, for example, consists of a zirconium oxide. Then, the piezoelectric element 39 is formed at a position corresponding to each of the pressure chambers 46 on the diaphragm 38 and the insulating film. On the piezoelectric element 39, the diaphragm 38, and the insulating film in the embodiment, a lower electrode film made of metal, a piezoelectric layer made of lead zirconate titanate (PZT) or the like, and an upper electrode film made of metal (not shown) are stacked in this order (not shown). In this configuration, one of the upper electrode film and the lower electrode film is used as a common electrode, and the other is used as an individual electrode. In addition, the electrode film to be an individual electrode and the piezoelectric layer are patterned for each of the pressure chambers 46.

On the upper surface of the communication substrate 36 on which the pressure chamber forming substrate 37 and the piezoelectric element 39 are stacked, the protective substrate 40 is disposed. The protective substrate 40 is made of, for example, glass, a ceramic material, a silicon single crystal substrate, metal, synthetic resin, or the like. In the protective substrate 40, a recess 48 having a size large enough not to hinder the driving of the piezoelectric element 39 is formed in an area facing the piezoelectric element 39. The element terminal of the piezoelectric element 39 is electrically connected to one end of a flexible substrate 50. When a driving signal (a driving voltage) is applied to the piezoelectric element 39 through the flexible substrate 50 from a controller side of the printer, the piezoelectric element 39 deflects and deforms a piezoelectric active portion according to the change of the applied voltage so that the flexible surface partitioning one surface of the pressure chamber 46, that is, the diaphragm 38 is displaced in a direction approaching the nozzle 34 or away from the nozzle 34. In this way, pressure fluctuation occurs in the ink in the pressure chamber 46, and ink is ejected from the nozzle 34 by using the pressure fluctuation.

Figure 10:
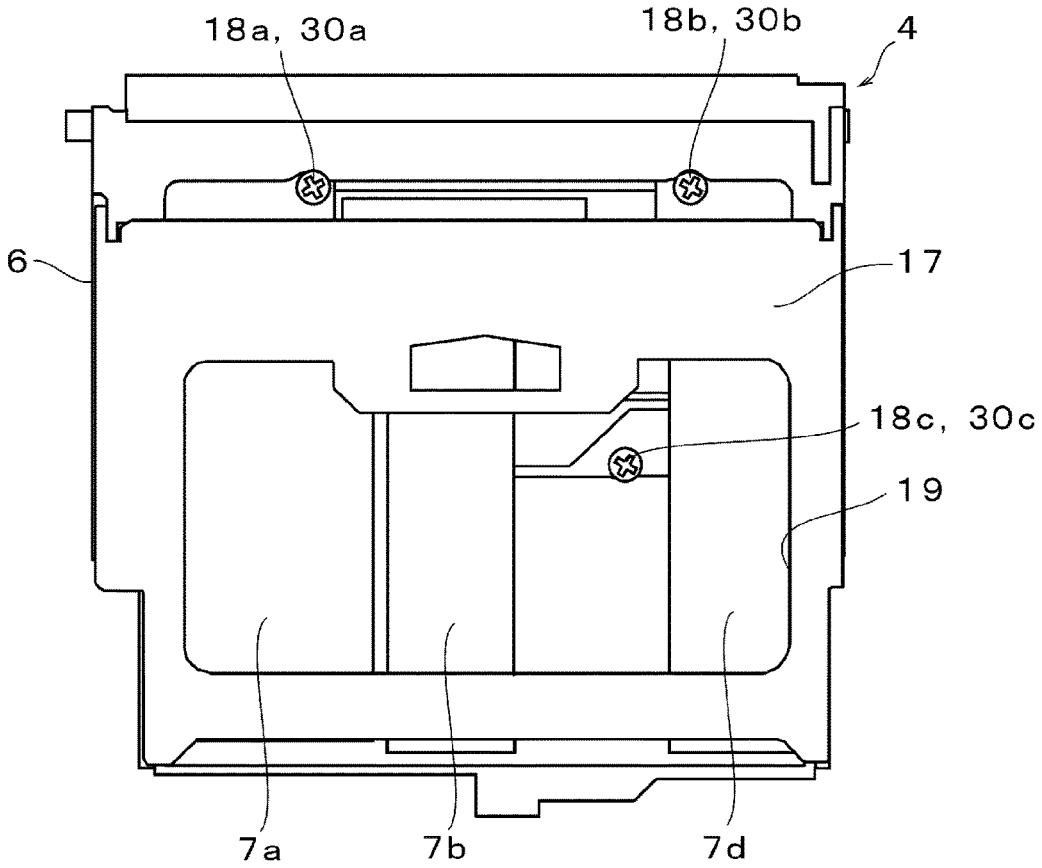
FIG. 10 is a top view for explaining a state of the head unit at the time of alignment adjustment.
Figure 11:
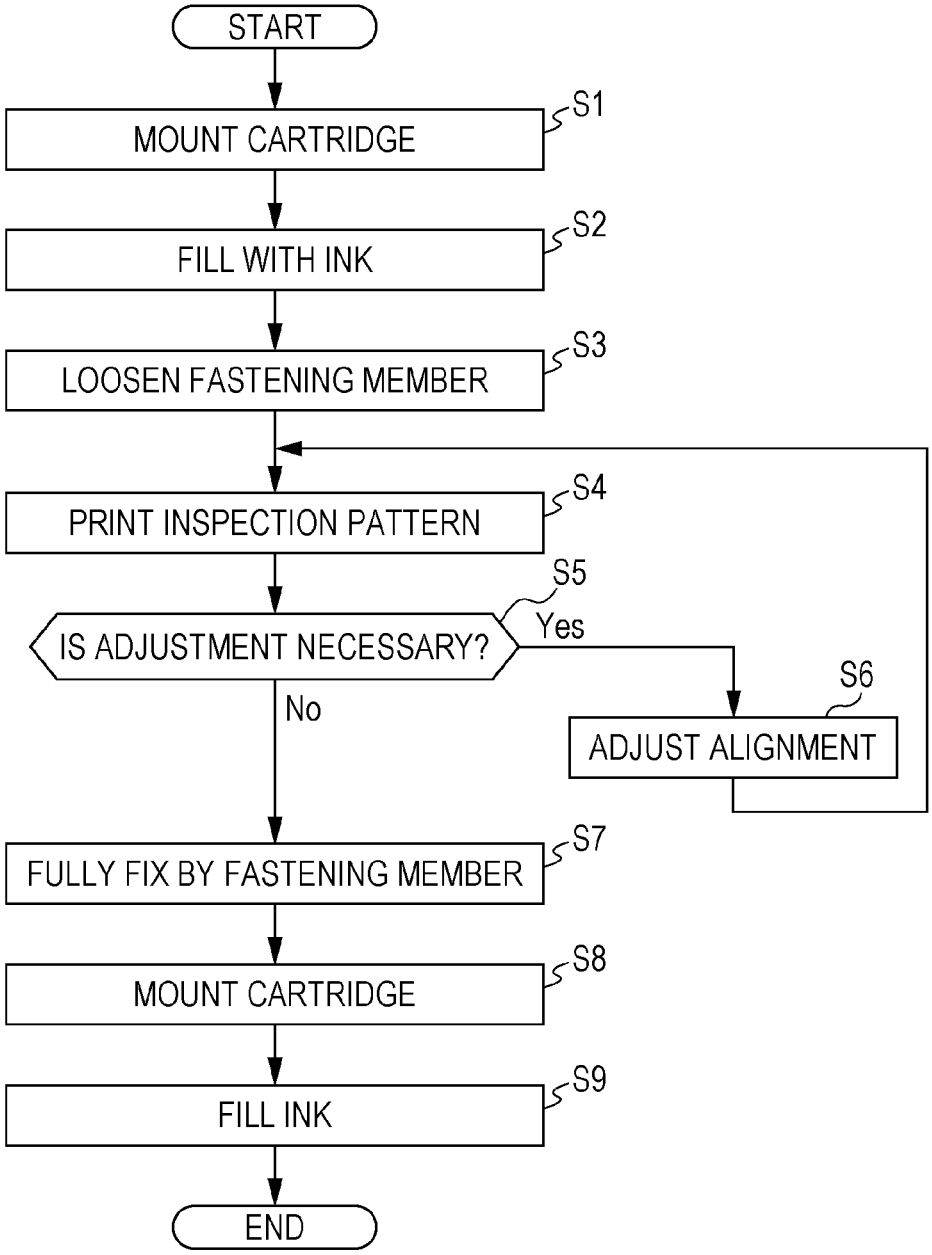
FIG. 11 is a flowchart for explaining a flow of a manufacturing method of the printer.

FIG. 10 is a plan view for explaining a state of the head unit 4 at the time of alignment adjustment. In addition, FIG. 11 is a flowchart for explaining a manufacturing method of the printer 1. In the following, alignment adjustment and fixation of the recording head 8 with respect to the carriage 6 will be mainly described. First, as described later, in order to fill the ink flow path of the recording head 8 with the ink (cyan ink in the embodiment) used for forming the inspection pattern relating to the alignment adjustment, the ink cartridge 7 is mounted on the carriage 6 in a state in which the recording head 8 is held in advance by the fastening member 18 (S1). Here, in order to adjust the alignment, it is necessary to make the adjustment tool such as a driver accessible to the adjustment members 30*a* to 30*c*. Then, in the embodiment, since the third adjustment member 30*c* is disposed at a position covered by the third ink cartridge 7*c*, at least the third ink cartridge 7*c* is not mounted so as to expose the third adjustment member 30*c*. In the embodiment, after the first ink cartridge 7*a*, the second ink cartridge 7*b*, and the fourth ink cartridge 7*d* are mounted in a cartridge mounting step S1, the cover 17 is closed as shown in FIG. 10. In this way, each of the ink cartridges 7*a*, 7*b*, and 7*d* is mounted more reliably. Since the opening 19 is formed in the cover 17, the third adjustment member 30*c* is exposed inside the opening 19. For this reason, the adjustment tool for loosening or tightening a third fastening member 18*c* of the third adjustment member 30*c* can be accessed while the cover 17 is kept closed at the time of the subsequent alignment adjustment. That is, alignment adjustment can be performed in a state in which the cover 17 is closed. For this reason, the cover 17 does not disturb the operation and workability is improved.

Subsequently, the filling step of ink is performed by the capping mechanism 13 (S2). That is, the pump unit is operated and sucked by the cap 14 in a state in which the nozzle forming surface is capped so that the ink in the ink cartridge 7 mounted on the carriage 6 is filled in the ink flow path up to the nozzle 34 of the recording head 8. Here, as described above, since the cap 14 in the embodiment is independent for each ejection unit 23, it is possible to selectively fill the ink flow path to be filled with ink. That is, in the embodiment, ink is filled in each ink flow path corresponding to each of the nozzle arrays 49*a*, 49*c*, 49*d*, 49*e*, 49*f*, 49*h* other than the second nozzle array 49*b* and the seventh nozzle array 49*g* corresponding to the yellow ink of the third ink cartridge 7*c*. However, even if the cap 14 is not independent for each ejection unit 23, the ink used for forming the inspection pattern may be filled.

After the ink is filled in the ink flow path to be filled, the fastening member 18 of the adjustment member 30 tightened and fixed (temporarily held) to the screw hole of the carriage 6 is subsequently loosened (S3). That is, as the first fastening member 18*a* of the first adjustment member 30*a*, the second fastening member 18*b* of the second adjustment member 30*b*, and the third fastening member 18*c* of the third adjustment member 30*c* are sequentially rotated in the loosening direction by the adjustment tool (not shown) in a range not detached from the screw holes, respectively, the position of the recording head 8 with respect to the carriage 6 can be adjusted within the range of the gap formed between the adjustment hole 20 and the axis of the fastening member 18. In a broad sense, the operation for fastening the fastening member 18 by screwing the fastening member 18 into the screw hole or the operation for loosening the fastened fastening member 18 (an operation for releasing the fastening) is also one kind of adjustment by the adjustment member in the invention. As described above, since the third adjustment member 30*c* provided at a position covered by the third ink cartridge 7*c* is disposed such that the third ink cartridge 7*c* is detached from the carriage 6, the third fastening member 18*c* of the third adjustment member 30*c* can be loosened by the adjustment tool (an operation of rotating the third fastening member 18*c*) through the opening 19 of the cover 17.

Next, the recording paper is set in the printer 1, and the inspection pattern is printed (formed) by ejecting ink from the nozzle 34 of the recording head 8 on the recording paper (S4). That is, this step is a kind of ejection step in the invention. In addition, the inspection pattern formed is a kind of ejection result in the invention. As the inspection pattern, for example, ruled lines formed by ejecting ink from nozzles 34 of at least two or more rows of the nozzle arrays 49 are adopted. That is, the ruled lines (vertical ruled lines along the sub-scanning direction or horizontal ruled lines intersecting the sub-scanning direction) are printed from a plurality of nozzle arrays 49 having different positions in the main scanning direction, and presence or absence, and degree of inclination of the recording head 8 with respect to the carriage 6 (inclination with respect to the main scanning direction and the sub-scanning direction) are inspected based on the positions of these ruled lines in the sub-scanning direction. The inspection may be carried out by visually checking the inspection pattern printed on the recording paper by a person involved in the inspection, and the inspection pattern printed on the recording paper may be optically read by a scanner or the like and may be performed by image processing or the like based on the image data of the obtained inspection pattern. As a method of inspecting the inclination of the recording head 8 with respect to the carriage 6, various well-known methods can be adopted. In summary, any method may be used as long as it is possible to ascertain the inclination of the recording head 8 with respect to the carriage 6 based on the ejection result when the ink is ejected from the nozzle 34.

In the embodiment, the cyan ink is used as ink to form the inspection pattern. That is, when the inspection pattern is formed, the yellow ink of the third ink cartridge 7*c* removed from the carriage 6 is not used. In order to cause the yellow ink to be ejected in a state in which the third ink cartridge 7*c* is not mounted and the ink flow path corresponding to the third ink cartridge 7*c* is not filled with yellow ink, even if the corresponding piezoelectric element 39 of the ejection unit 23 is driven, there is a concern that gas (air) flows into the ink flow path corresponding to the yellow ink, ink is not normally ejected from the nozzle 34, and the inspection pattern cannot be normally formed, so there is a possibility that alignment adjustment by the adjustment member is hindered. In the embodiment, by using the cyan ink of the fourth ink cartridge 7*d* mounted on the carriage 6 as the ink for forming the inspection pattern, it is possible to eject ink from the corresponding nozzle 34, and alignment adjustment by the adjustment member 30 can be performed without any trouble based on the formed inspection pattern. In addition, according to the configuration in the embodiment, since the ejection unit 23 can eject ink from the fourth ink cartridge 7*d* without mounting the third ink cartridge 7*c*, it is unnecessary to attach and detach the third ink cartridge 7*c* in advance in performing the adjustment by the adjustment member 30*c*.

In addition, as the ink for forming the inspection pattern, ink with lower brightness (intensity) on the recording medium (recording paper) than the ink (in the embodiment, the yellow ink stored in the third ink cartridge 7*c*) stored in the ink cartridge 7 removed from the carriage 6 in an alignment adjustment step is used. In other words, the brightness of the yellow ink stored in the third ink cartridge 7*c* is higher than the brightness of the cyan ink stored in the second ink cartridge 7*b*. The brightness is represented by, for example, L*value in a L*a*b* color specification system (CIELAB color space) defined in JIS Z8729. More specifically, the above-described L* obtained by measuring the optical density (OD) of a printed material obtained by performing 100% duty printing at a resolution of 1440×720 [dpi] using ink of each ink cartridge 7 on the recording medium with a spectrocolorimeter, is defined as "brightness". The above-described "duty" is defined by the following formula (A) and indicates a unit of a value D to be calculated.

$$D=100\times(\text{number of actual printing dots})/(\text{vertical resolution}\times\text{lateral resolution}) \quad (A)$$

100% duty means the maximum ink weight of a single color with respect to a pixel.

In this way, as the ink for forming the inspection pattern, ink with lower brightness than the ink of the ink cartridge 7 removed from the carriage 6 in the alignment adjustment step is used, in a case where inspection of the inclination of the recording head 8 (a deviation of a nozzle position) is visually observed with respect to the inspection pattern, it is easier for the inspection personnel to visually recognize the inspection pattern, and even in a case where the inspection is performed based on the image data of the inspection pattern, it is possible to easily recognize the inspection pattern by a computer or the like. As a result, the accuracy of determination on the inclination of the recording head 8 based on the inspection pattern is improved, and as a result, an adjustment system in the alignment adjustment is improved.

In the embodiment, since the ink (cyan ink) used for forming the inspection pattern is allocated to the first nozzle array 49*a* and the eighth nozzle array 49*h* positioned at both ends of the nozzle arrays among the nozzle arrays 49*a* to 49*h* in the recording head 8 in the nozzle array juxtaposition direction, in a case where there is alignment deviation of the recording head 8 in the inspection pattern by forming the inspection pattern using only the cyan ink, the deviation appears more conspicuously, so it is possible to inspect the positional relationship of each of the nozzles 34 with respect to the carriage 6 more accurately. For this reason, in the embodiment, the configuration in which only the third ink cartridge 7*c* is not mounted is exemplified, but the invention is not limited thereto. The ink cartridge 7 (for example, the first ink cartridge 7*a* and the second ink cartridge 7*b*) of ink other than the ink used for forming the inspection pattern, which is the ink cartridge 7 other than the third ink cartridge 7*c*, may not be mounted. In this way, by adopting a configuration in which there are a plurality of ink cartridges 7 that need not be mounted on the carriage 6 at the time of alignment adjustment, the degree of freedom of arrangement layout of the adjustment member 30 is improved.

Subsequently, based on the inspection pattern formed as described above, it is determined whether or not alignment adjustment of the recording head 8 is necessary (S5). In a case where it is determined that the alignment adjustment of the recording head 8 is necessary (Yes) as a result of the inspection based on the inspection pattern, by adjusting the position of the ink introduction member 21 with respect to the carriage 6, alignment adjustment of the recording head 8 in the carriage 6 is performed (S6). As a result, a positional relationship (a positional relationship between the carriage 6 and the dots formed on the recording medium ejected from the nozzles 34) of each nozzle 34 of the recording head 8 with respect to the carriage 6 is adjusted. Since the alignment adjustment of the recording head 8 in the above-described carriage 6 is well known, a detailed description thereof will be omitted, but various adjustment mechanisms and members can be used as long as the position of the recording head 8 with respect to the carriage 6 can be adjusted within the range of the gap formed between the adjustment hole 20 and the axis of the fastening member 18. In the embodiment, alignment adjustment is performed by using an adjustment mechanism (an adjustment member in a narrow sense) provided on the carriage 6 separately from the adjustment members 30*a* to 30*c*. For example, alignment adjustment is performed by a rotating cam mechanism or a sliding mechanism (not shown) having a cam surface that abuts on the ink introduction member 21, or a mechanism having a combination of an abutment surface against which the ink introduction member 21 abuts and an energizing member for energizing the ink introduction member 21 toward the abutment surface side or the like. In addition, for example, it is possible to adopt a configuration in which the recording head 8 is held by a separate jig and the recording head 8 and the carriage 6 are relatively moved by the jig.

In addition, a configuration in which the third adjustment member 30*c* disposed at a position covered by the ink cartridge 7 functions as an adjustment mechanism such as the cam mechanism and the slide mechanism without providing an adjustment mechanism separately from the adjustment members 30*a* to 30*c*, and the first adjustment member 30*a* and the second adjustment member 30*b* disposed at positions not covered by the ink cartridge 7 mainly function as a fastening member may be adopted. That is, in this case, the third adjustment member 30*c* functions as an adjustment member in a narrow sense for directly performing alignment adjustment by itself (a force acts directly or indirectly on the ink introduction member 21 which is a member to be aligned by the operation of the third adjustment member 30*c*). On the other hand, the first adjustment member 30*a* and the second adjustment member 30*b* mainly function as a fastening member for fixing or fastening the ink introduction member 21 (the recording head 8) directly or indirectly to the carriage 6 and do not function as a mechanism (an adjustment member in a narrow sense) for performing alignment adjustment by themselves. However, since the position of the ink introduction member 21 (the recording head 8) with respect to the carriage 6 can be adjusted within the range of the gap formed between the adjustment hole 20 and the axis of the fastening member 18 as described above, it can be said that the first adjustment member 30*a* and the second adjustment member 30*b* function as an adjustment member for performing alignment adjustment indirectly in a broad sense.

Then, a plurality of adjustment mechanisms as adjustment members directly relating to adjustment of alignment may be provided, but it is desirable that at least one adjustment member (an adjustment member in a narrow sense) is disposed at a position covered by any of the ink cartridges 7 so that the adjustment tool or the like can access the ink cartridge 7*c* (disposed in such a position) in a state in which the ink cartridge 7*c* is removed. In this way, by adopting a configuration in which the adjustment member is covered by the ink cartridge 7 except for the replacement operation of the ink cartridge 7 or the like, application of an unintended external force to the adjustment member is suppressed. In this way, a positional deviation of the ink introduction member 21 (the recording head 8) is suppressed after adjustment of alignment. In addition, it is desirable that the number of the adjustment members is less than the number of the fastening members. In this way, it is possible to reduce the number of the ink cartridges 7 that need to be removed from the carriage 6 at the time of alignment adjustment by the adjustment member.

Once the alignment adjustment is performed, printing of the inspection pattern is performed again (S4), and the subsequent steps (S4 to S6) are repeated until it is determined that adjustment is unnecessary. As a result of the inspection based on the inspection pattern, in a case where it is determined that the alignment adjustment of the recording head 8 is unnecessary (No in S5), that is, in a case where it is determined that the recording head 8 is correctly mounted without inclination with respect to the carriage 6 (the positional relationship of the nozzles 34 of the recording head 8 with respect to the carriage 6 is in a desired state), subsequently, the fastening member 18 of the adjustment member 30 is tightened, whereby the recording head 8 is fixed to the carriage 6 (S7). That is, in the embodiment, the first fastening member 18*a* of the first adjustment member 30*a*, the second fastening member 18*b* of the second adjustment member 30*b*, and the third fastening member 18*c* of the third adjustment member 30*c* are sequentially rotated in the direction of tightening by the adjustment tool so that the recording head 8 is fully fixed to the carriage 6. Also in this case, it is possible to perform an operation of tightening the third fastening member 18*c* of the third adjustment member 30*c* with the adjustment tool (an operation of rotating the third fastening member 18*c*) through the opening 19 of the cover 17. The ink introduction member 21 (the recording head 8) and the carriage 6 may not be directly fixed to each other. For example, another member may be disposed between the ink introduction member 21 and the carriage 6 so that the ink introduction member 21 is indirectly fixed to the carriage 6.

After the recording head 8 is fixed to the carriage 6, the third ink cartridge 7*c* which has been removed for alignment adjustment is subsequently mounted on the carriage 6 (S8). At this time, since the recording head 8 is already fixed to the carriage 6 by the fastening members 18*a* to 18*c* after the alignment adjustment, even if an external force acts between the recording head 8 and the carriage 6 in accordance with the mounting operation of the third ink cartridge 7*c*, the positional deviation of the recording head 8 is suppressed, and the adjustment result of the alignment can be maintained satisfactorily. Subsequently, the filling step of the ink stored in the third ink cartridge 7*c* is performed by the capping mechanism 13 (S9). That is, the yellow ink of the third ink cartridge 7*c* is selectively filled in the ink flow paths of the nozzle arrays 49 other than the second nozzle array 49*b* and the seventh nozzle array 49*g* corresponding to the yellow ink of the third ink cartridge 7*c*.

In this way, alignment adjustment and fixation of the recording head 8 with respect to the carriage 6 is performed. Here, for the sake of comparison with the manufacturing method according to the invention, a manufacturing method which has been carried out in the configuration of the related art will be briefly described with reference to the flowchart of FIG. 12. It is assumed that some adjustment members are covered with a specific ink cartridge in a head unit of the related art, and an adjustment tool or the like cannot access the adjustment members in a state in which the ink cartridge is mounted. First, all the ink cartridges are mounted on the carriage on the carriage (S11), the ink cartridge covering the adjustment member is removed after ink is filled (S12), and the adjustment member covered by the ink cartridge is exposed (S13). Then, after the adjustment member is loosened (S14), the removed ink cartridge is again mounted on the carriage (S15). When printing of the inspection pattern (S16) and alignment adjustment (S18) are completed (No in S17), the ink cartridge covering the adjustment member is removed again to expose the adjustment member covered by the ink cartridge (S19). Then, after the recording head is fully fixed to the carriage by the fastening member (S20), the removed ink cartridge is mounted on the carriage (S21). In this way, in the manufacturing method of the related art, the number of times of insertion and removal of the ink cartridge is larger than that of the manufacturing method according to the invention. Moreover, there is a concern that an external force is applied between the recording head and the carriage when the ink cartridge is removed after the alignment adjustment and before the full fixation, whereby the position of the recording head is deviated. From the viewpoint of reducing the number of steps of inserting and removing the cartridge, it is conceivable to adopt a configuration in which the adjustment member is disposed at a position not covered by the ink cartridge, but there is a problem that the size of the entire recording head (a head unit) is increased accordingly. That is, in order to provide a portion to be fixed by the adjustment member and an area for adjusting the adjustment member (an area required for an operation of the adjustment member) up to that position, it is necessary to extend the carriage 6 and the like, and the apparatus becomes large. In particular, as the size of the ink cartridge is increased, the size of the recording head is increased, which hinders the increase in the capacity of the ink cartridge.

Figure 12:
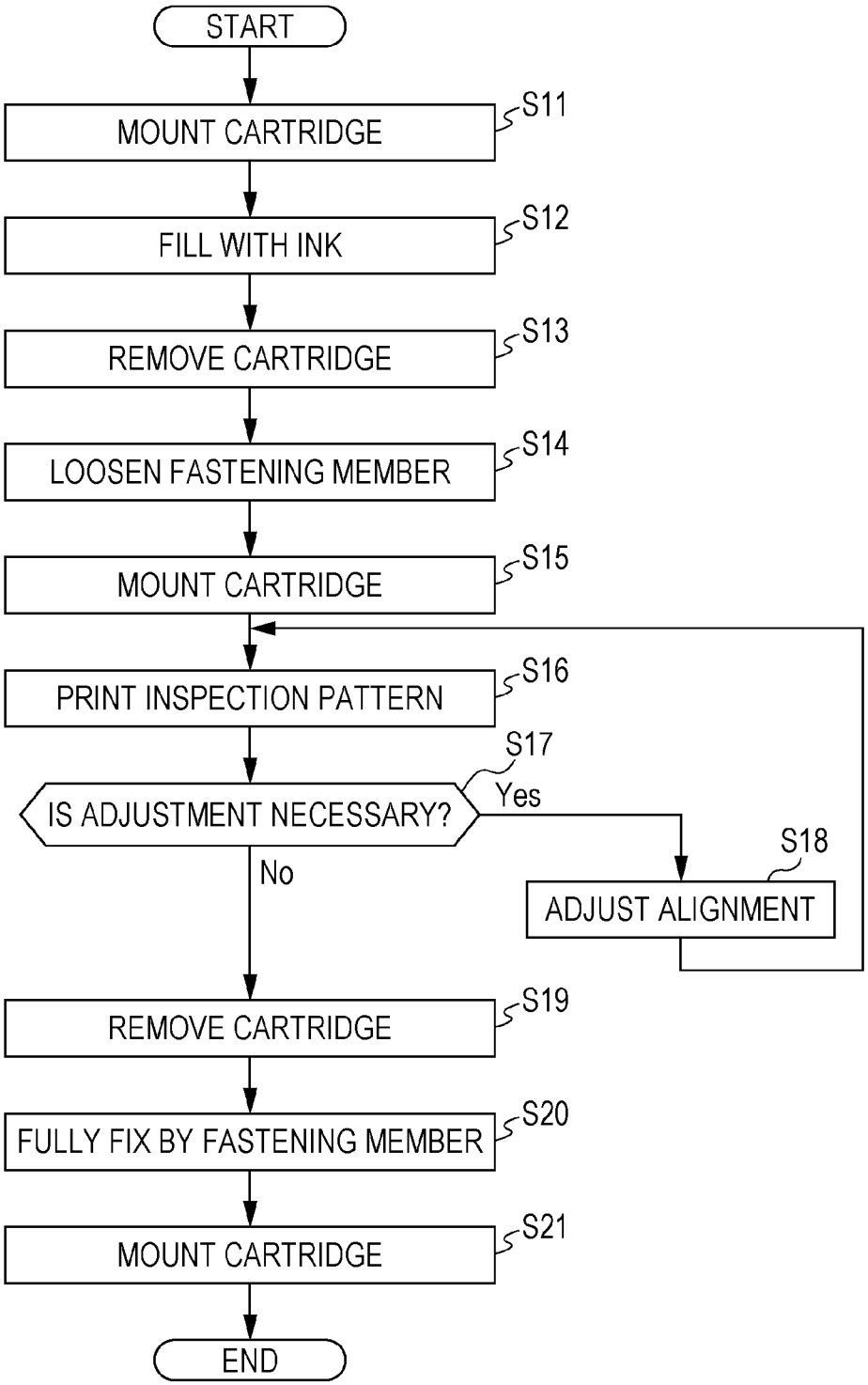
FIG. 12 is a flowchart for explaining a flow of a manufacturing method of the printer in the related art as a comparative example.

On the other hand, according to the manufacturing method of the invention, since each step is performed in a state in which the third ink cartridge 7*c* covering the third adjustment member 30*c* is removed, compared with the manufacturing method of the related art as shown in FIG. 12, the number of steps of inserting and removing the ink cartridge 7 can be reduced, and the entire manufacturing process can be shortened. In addition, since there is no process for inserting and removing the ink cartridge 7 before the recording head 8 is fully fixed to the carriage 6 by the fastening member 18 after the alignment is adjusted, the positional deviation of the recording head 8 with respect to the carriage 6 after alignment adjustment is suppressed. Then, since the adjustment member 30 can be disposed at a position covered by the ink cartridge 7, it is possible to downsize the recording head 8 (the head unit 4) and to cope with an increase in size (increase in capacity) of the ink cartridge accordingly.

Figure 13:
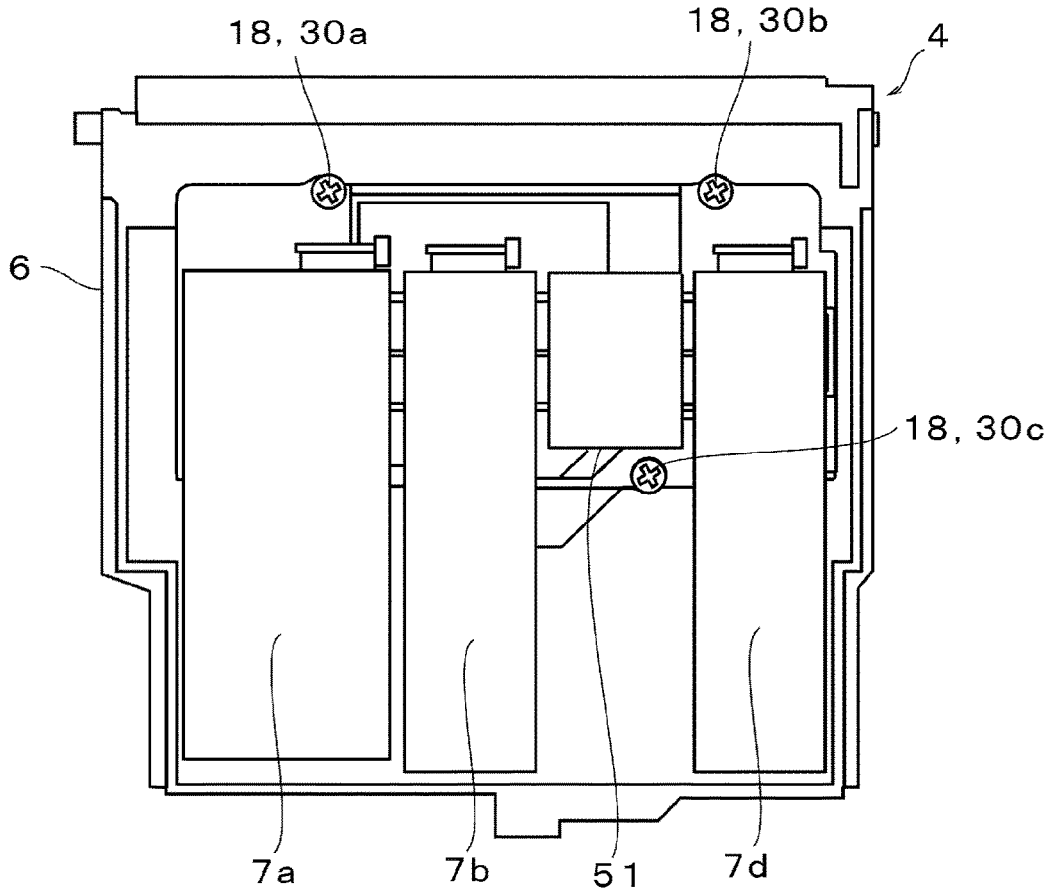
FIG. 13 is a top view for explaining a state of the head unit at the time of alignment adjustment in a second embodiment.

FIG. 13 is a plan view for explaining a state of the head unit 4 in the second embodiment of the invention at the time of alignment adjustment (a state in which the cover 17 is removed). While the cap 14 in the capping mechanism 13 is individually provided for each ejection unit 23 in the above-described first embodiment, the second embodiment is different from the first embodiment in that the cap 14 is a single cap common to all the nozzle arrays 49*a* to 49*h* of the recording head 8. In the embodiment, when suction is simultaneously performed from all the nozzle arrays 49*a* to 49*h* in a state in which the third ink cartridge 7*c* is not mounted, because the ink flow path corresponding to the third ink cartridge 7*c* communicates with the atmosphere, a negative pressure does not sufficiently act on the ink flow path to be filled, resulting in a problem that filling efficiency deteriorates. For this reason, at the time of filling processing or the like in the embodiment, a dummy cartridge 51 (a kind of flow regulating member) is mounted on a third ink introduction needle 24*c* (a kind of connection portion in the invention) at a position where the third ink cartridge 7*c* is mounted. The dummy cartridge 51 is a member that regulates air flowing into the ink flow path from the introduction hole 26 of the ink introduction needle 24 at the time of suction by being attached to the ink introduction needle 24 (to adjust an inflow amount of fluid), which includes a flow rate control valve, for example. The dummy cartridge 51 has a shape such that the dummy cartridge 51 can be mounted at a predetermined mounting position of the third ink cartridge 7*c*, and at least the dimension in the depth direction (the sub-scanning direction) than the ink cartridge 7 is designed to be small so that the third adjustment member 30*c* is configured to be exposed in a state of being mounted on the carriage 6. As the dummy cartridge 51 is mounted on the third ink introduction needle 24*c* at a position where the third ink cartridge 7*c* is mounted at the time of filling ink in this way, the negative pressure caused by the suction acts more effectively on the ink flow path to be filled with ink, and an ink filling operation can be performed more smoothly and more efficiently.

The shape and dimensions of the dummy cartridge 51 are not limited to what is illustrated. In brief, the dummy cartridge 51 may be of any shape and dimensions as long as the dummy cartridge 51 can regulate the air flowing into the ink flow path from the introduction hole 26 of the ink introduction needle 24 at the time of filling ink and expose the third adjustment member 30*c* in a state of being mounted on the carriage 6. In addition, the dummy cartridge 51 does not necessarily have to be used. For example, in a state in which the third ink cartridge 7*c* is mounted, it is possible to fill ink in the ink flow path corresponding to the third ink cartridge 7*c*, remove the third ink cartridge 7*c* after filling, and perform the subsequent steps.

In addition, in the above-described embodiment, the configuration in which the cyan ink of the fourth ink cartridge 7*d* mounted on the carriage 6 is used as the ink for forming the inspection pattern is exemplified, but the invention is not limited thereto. For example, the ink stored in the ink cartridge 7 removed from the carriage 6 at the time of alignment adjustment can be used for forming the inspection pattern. That is, before the ink cartridge 7 is detached, the ink flow path corresponding to the ink cartridge 7 is filled with ink, and the ink cartridge 7 is removed after being filled. Then, at the time of forming the inspection pattern, the ink remaining in the ink flow path is ejected from the nozzle 34 of the nozzle array 49 corresponding to the ink flow path, and the inspection pattern is formed. At this time, in a case where ink is ejected as it is, there is a possibility that air may flow into the ink flow path from the ink introduction needle 24 side and hinder the ejection of the ink. On the other hand, in a case where an entrance of the introduction hole 26 of the ink introduction needle 24 is closed so that air does not flow into the ink flow path, as the ink is ejected from the nozzle 34 by the driving of the ejection unit 23 (the piezoelectric element 39), the negative pressure inside the ink flow path increases, and even in this case, there is a possibility that the ink cannot be ejected normally. Relating to this point, by mounting the dummy cartridge 51 on the mounting position of the removed ink cartridge 7, the above-described trouble is suppressed. That is, since the dummy cartridge 51 is mounted, and an inflow amount of air is regulated while allowing air to flow into the ink flow path, the supply pressure of the ink in the pressure chamber 46 is adjusted to a desired state, whereby the above-described trouble can be reduced. Also in this configuration, as the ink used for forming the inspection pattern, it is desirable to use ink (ink with lower brightness) which is advantageous for visually recognizing the inspection pattern and the like.

In the above-described embodiment, the alignment adjustment between the ink introduction member 21 (the flow path member) and the carriage 6 (the container holding member) is exemplified as the adjustment relating to the ejection of the ejection unit 23 (the ejection mechanism), but the invention is not limited thereto. The invention can also be applied to adjustment of an optical sensor or the like provided in the container holding member as long as the adjustment is performed based on the ejection result by the ejection mechanism. As the sensor, a sensor for recognizing the liquid (a dot) landed on the landing target of the liquid ejected by the ejection mechanism, a sensor for measuring a distance from a nozzle to the landing target of the liquid, or a sensor for recognizing the end of the landing target of the liquid can be mentioned. Then, it is also possible to adopt a configuration in which alignment is adjusted by the adjustment member so as to dispose the sensor at a more desirable position (a position where the inspection pattern as an ejection result can be more clearly recognized) as initialization based on the ejection result by the ejection mechanism, or adjustment of a focal point or the like is performed without changing the disposition of the sensor. These adjustments are also a kind of adjustment of the liquid ejecting apparatus.

In addition, for example, the invention can be applied to a configuration having a mechanism for adjusting the supply pressure of the liquid to the ejection mechanism. For example, the invention can also be applied to a configuration in which ejection characteristics of the liquid ejected from nozzles of the ejection mechanism is adjusted by changing a cross-sectional area of the flow path by a rotation amount of the adjustment member such as a screw or the like and changing the supply pressure of the liquid to the ejection mechanism based on the ejection result (dot size, a landing position, and the like) by the ejection mechanism. The invention can also be applied to a configuration having an adjustment member for adjusting the distance (also referred to as platen gap or paper gap) from the nozzle of the ejection mechanism to a landing target of the liquid. For example, if an amount of unnecessary liquid droplets (satellite droplets) caused by the ejection of the liquid is relatively large as the ejection result by the ejection mechanism, the distance can be set smaller by the adjustment member so that the printing quality can be more emphasized, or if the amount of satellite droplets is relatively small, the distance can be set to be larger by the adjustment member so that collision of the medium (a landing target) to the ejection mechanism or reduction of an amount of dust adhering can be more emphasized. These adjustments are also a kind of adjustment of the liquid ejecting apparatus. In order to adjust based on these ejection results, the inspection pattern is not necessarily required, and necessity of adjustment or the degree of adjustment may be specified by a sensor or the like.

Then, in the above-described embodiment, the printer 1 is illustrated as the liquid ejecting apparatus, for example, the head unit 4 is also a kind of the liquid ejecting apparatus in a broader sense. In addition, the invention can also be applied to other liquid ejecting apparatuses that eject liquid eject from a nozzle. For example, the invention is also to a color material ejecting head used for manufacturing a color filter such as a liquid crystal display, an organic electroluminescence (EL) display, an electrode material ejecting head used for formation of electrodes such as an FED (a surface emitting display), a bioorganic material ejecting head used for manufacturing a biochip (a biochemical element), and the like. In the color material ejecting head for the display manufacturing apparatus, solution of each color material R (Red), G (Green), B (Blue) is ejected as a kind of liquid. In addition, in the electrode material ejecting head for an electrode forming apparatus, a liquid electrode material as a kind of liquid is ejected, and in the bioorganic material ejecting head for a chip manufacturing apparatus, solution of a bioorganic material as a kind of liquid is ejected.

The entire disclosure of Japanese Patent Application No. 2016-168866, filed Aug. 31, 2016 is expressly incorporated by reference herein.

What is claimed is:

1. A method of manufacturing a liquid ejecting apparatus which includes a container holder on which a first liquid container and a second liquid container are detachably mounted, nozzles for ejecting the liquid supplied from each of the liquid containers, and an adjuster that is disposed at a position covered by the first liquid container and not covered by the second liquid container, the method comprising:

ejecting liquid by the nozzles in a state in which the second liquid container is mounted without the first liquid container being mounted; and adjusting the liquid ejecting apparatus by the adjuster based on an ejection result in the ejecting of the liquid.

2. The method of manufacturing a liquid ejecting apparatus according to claim 1, wherein the nozzles ejects liquid supplied from the second liquid container in the ejecting of the liquid.

3. The method of manufacturing a liquid ejecting apparatus according to claim 2, wherein brightness of the liquid of the first liquid container is higher than the brightness of the liquid of the second liquid container.

4. The method of manufacturing a liquid ejecting apparatus according to claim 1, wherein the liquid ejecting apparatus further includes a fastener provided at a position not covered by the first liquid container and the second liquid container, and the adjusting of the liquid ejecting apparatus is performed by the fastener and the adjuster.

5. The method of manufacturing a liquid ejecting apparatus according to claim 1, wherein the liquid ejecting apparatus further includes a flow path member having a flow path for supplying the liquid from the first liquid container and the second liquid container to the nozzles, and adjusting alignment of the flow path member with respect to the container holder in the adjusting of the liquid ejecting apparatus.

6. The method of manufacturing a liquid ejecting apparatus according to claim 5, wherein a nozzle group of the nozzles for the first liquid container is sandwiched between the respective nozzle groups of the nozzles for the second liquid container.

7. The method of manufacturing a liquid ejecting apparatus according to claim 5, wherein the container holder is configured as a carriage for reciprocally moving the flow path member, and the carriage and the flow path member are fixed to each other in the adjusting of the liquid ejecting apparatus.

8. The method of manufacturing a liquid ejecting apparatus according to claim 7, wherein a relative position between the carriage and the nozzles is adjusted in the adjusting of the liquid ejecting apparatus.

9. The method of manufacturing a liquid ejecting apparatus according to claim 1, further comprising:

simultaneously sucking the nozzles corresponding to the first liquid container and the second liquid container respectively to fill the liquid flow path of the nozzles for the second liquid container in a state in which a flow regulating member that regulates the flow of gas to the nozzles is mounted on a connection portion of the container holder for the first liquid container while the second liquid container is being mounted on the container holder before the ejecting of the liquid.

10. A liquid ejecting apparatus comprising:

a container holder configured to detachably mount a first liquid container and a second liquid container thereon;

nozzles for ejecting the liquid supplied from each of the liquid containers; and an adjuster, wherein the adjuster is disposed at a position covered by the first liquid container and not covered by the second liquid container such that the adjuster is only accessible in a state that the first liquid container is not mounted in the liquid container.

11. The liquid ejecting apparatus according to claim 10, wherein the nozzles is configured to eject liquid from the second liquid container in a state in which the first liquid container is not mounted on the container holder and the second liquid container is mounted on the container holder in a case where a relative position between the container holder and a fixed member to be fixed to the container holder is adjusted by the adjuster based on an ejection result when liquid is ejected by the nozzles.

12. The liquid ejecting apparatus according to claim 10, wherein the container holder has a cover that covers at least a part of the first liquid container and the second liquid container, the adjuster is configured to be rotatable about a rotation axis, and the cover has an opening on an extension line of an operation position for rotating the adjuster in the rotation axis direction.

13. The liquid ejecting apparatus according to claim 10, further comprising:

a fastener for fixing a carriage and a flow path member, wherein the container holder is configured as the carriage for reciprocally moving the flow path member in a first direction, the fixed member is configured as the flow path member having a flow path for supplying the liquid from the first liquid container and the second liquid container to the nozzles, the adjuster is used for adjusting alignment between the carriage and the flow path member, and the fastener is provided at a position not covered by the first liquid container and the second liquid container.

14. The liquid ejecting apparatus according to claim 13, wherein the number of the adjusters is less than the number of the fasteners.

15. The liquid ejecting apparatus according to claim 13, wherein adjusters and fasteners are provided in a total of three or more and disposed in a nonlinear manner in which three or more adjusters and fasteners are not arranged on the same straight line.

16. The liquid ejecting apparatus according to claim 13, further comprising:

a flow path member having a flow path for supplying the liquid from the first liquid container and the second liquid container to the nozzles, wherein the flow path member has an upstream member to which liquid is supplied from the first liquid container and the second liquid container and a downstream member to which liquid is supplied from the upstream member, the adjuster and the fastener are provided on the upstream member side to fix the upstream member and the carriage to each other, and the upstream member is longer than the downstream member in the first direction, and the fastener is disposed at a position away from the downstream member.

17. The liquid ejecting apparatus according to claim 16, wherein the fastener is positioned closer to the downstream member side than the center of a protruding range among the protruding ranges of the upstream member away from the downstream member in the first direction.

18. The liquid ejecting apparatus according to claim 10, wherein a nozzle group of the nozzle for the first liquid container is sandwiched between the respective nozzle groups of the nozzles for the second liquid container.

19. The liquid ejecting apparatus according to claim 10, wherein the brightness of the liquid of the first liquid container is higher than the brightness of the liquid of the second liquid container.

* * * * *